US006519431B1

(12) United States Patent
Toba et al.

(10) Patent No.: US 6,519,431 B1
(45) **Date of Patent: *Feb. 11, 2003**

(54) PROCESS CARTRIDGE, ASSEMBLING METHOD THEREFOR AND ELECTROPHOTOGRAPHIC IMAGE FORMING APPARATUS

(75) Inventors: Shinjiro Toba, Shizuoka-ken (JP); Tadayuki Tsuda, Susono (JP); Shigeo Miyabe, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 16 days.

(21) Appl. No.: 09/575,535

(22) Filed: May 22, 2000

(30) Foreign Application Priority Data

May 20, 1999 (JP) ..... 11-139420
May 20, 1999 (JP) ..... 11-139900
May 16, 2000 (JP) ..... 2000-143252

(51) Int. Cl.[7] ..... G03G 21/16
(52) U.S. Cl. ..... 399/111; 399/117
(58) Field of Search ..... 399/111, 113, 399/119, 107, 109, 117

(56) References Cited

U.S. PATENT DOCUMENTS 4,757,344 A * 7/1988 Idenawa et al. ..... 399/113
5,105,221 A * 4/1992 Takahashi et al. ..... 399/111
5,126,800 A 6/1992 Shishido et al.
5,151,734 A 9/1992 Tsuda et al.
5,208,634 A 5/1993 Ikemoto et al.
5,223,893 A 6/1993 Ikemoto et al.
5,294,960 A 3/1994 Nomura et al.
5,331,372 A 7/1994 Tsuda et al.
5,331,373 A 7/1994 Nomura et al.
5,345,294 A 9/1994 Nomura et al.
5,404,198 A 4/1995 Noda et al.
5,452,056 A 9/1995 Nomura et al.
5,463,446 A 10/1995 Watanabe et al.
5,470,635 A 11/1995 Shirai et al. ..... 428/131
5,475,470 A 12/1995 Sasago et al.
5,488,459 A 1/1996 Tsuda et al.
5,493,366 A * 2/1996 Satoh et al. ..... 399/111
5,510,878 A 4/1996 Noda et al. ..... 355/211
5,561,504 A 10/1996 Watanabe et al.
5,581,325 A 12/1996 Tsuda et al.

(List continued on next page.)

FOREIGN PATENT DOCUMENTS

JP 4-51255 2/1992
JP 2774859 4/1998

*Primary Examiner*—Susan S. Y. Lee
(74) *Attorney, Agent, or Firm*—Fitzpatrick, Cella, Harper & Scinto

(57) ABSTRACT

A process cartridge detachably mountable to a main assembly of an electrophotographic image forming apparatus, includes a developing member for developing an electrostatic latent image formed on an electrophotographic photosensitive drum, a toner accommodation frame having a developer accommodating portion for accommodating a developer to be used by a developing member to develop the electrostatic latent image, a drum frame for supporting the electrophotographic photosensitive drum, a developing frame for supporting the developing member, the developing frame being swingably coupled with the toner accommodation frame, a first end cover connected with the drum frame and the developing frame at one longitudinal end of each of the drum frame and the developing frame, and a second end cover connected with the drum frame and the developing frame at the other longitudinal end of the drum frame and the developing frame.

38 Claims, 21 Drawing Sheets

U.S. PATENT DOCUMENTS 5,583,613 A 12/1996 Kobayashi et al.
5,585,889 A 12/1996 Shishido et al.
5,602,623 A 2/1997 Nishibata et al. ..... 399/111
5,608,509 A 3/1997 Shirai et al. ..... 399/351
5,623,328 A 4/1997 Tsuda et al. ..... 399/111
5,640,650 A 6/1997 Watanabe et al. ..... 399/117
5,659,847 A 8/1997 Tsuda et al. ..... 399/113
5,669,042 A 9/1997 Kobayashi et al. ..... 399/111
5,758,243 A * 5/1998 Haneda et al. ..... 399/111 X
5,809,374 A 9/1998 Tsuda et al. ..... 399/111
5,812,909 A 9/1998 Oguma et al. ..... 399/104
5,828,928 A 10/1998 Sasago et al. ..... 399/111
5,839,028 A 11/1998 Nomura et al. ..... 399/109
5,873,012 A 2/1999 Miyabe et al. ..... 399/90
5,878,304 A 3/1999 Watanabe et al. ..... 399/92
5,878,309 A 3/1999 Nomura et al. ..... 399/111
5,878,310 A 3/1999 Noda et al. ..... 399/117
5,923,918 A 7/1999 Nakagawa et al. ..... 399/27
5,926,666 A 7/1999 Miura et al. ..... 399/25
5,943,529 A 8/1999 Miyabe et al. ..... 399/113
5,950,047 A 9/1999 Miyabe et al. ..... 399/111
5,966,567 A 10/1999 Matsuzuki et al. ..... 399/111
6,006,058 A 12/1999 Watanabe et al. ..... 399/167
6,011,941 A 1/2000 Takashima et al. ..... 399/111
6,029,031 A 2/2000 Yokomori et al. ..... 399/109
6,041,196 A 3/2000 Nakagawa et al. ..... 399/27
6,058,278 A 5/2000 Tsuda et al. ..... 399/106
6,064,843 A 5/2000 Isobe et al. ..... 399/111
6,072,967 A * 6/2000 Sugihara et al. ..... 399/113 X
6,072,968 A 6/2000 Nomura et al. ..... 399/113
6,075,956 A 6/2000 Watanabe et al. ..... 399/92

* cited by examiner

PROCESS CARTRIDGE, ASSEMBLING METHOD THEREFOR AND ELECTROPHOTOGRAPHIC IMAGE FORMING APPARATUS

FIELD OF THE INVENTION AND RELATED ART

The present invention relates to a process cartridge, an assembling method therefor and an electrophotographic image forming apparatus.

Here, the electrophotographic image forming apparatus forms an image on a recording material through an electrophotographic image-formation type process. Examples of electrophotographic image forming apparatus include an electrophotographic copying machine, an electrophotographic printer (a laser beam printer, an LED printer or the like), a facsimile machine and a word processor.

The above-described process cartridge contains as a unit an electrophotographic photosensitive member and a charging means, a developing means or a cleaning means in the form of a cartridge that is detachably mountable to a main assembly of an image forming apparatus. The process cartridge may contain an electrophotographic photosensitive member and at least one of a charging means, a developing means and a cleaning means in the form of a cartridge that is detachably mountably to a main assembly of an image forming apparatus. The process cartridge may contain an electrophotographic photosensitive member and at least developing means in the form of a cartridge that is detachably mountably to a main assembly of an image forming apparatus.

With a process cartridge type apparatus, the servicing or maintenance operations can be in effect carried out by the users, so that the operativity is significantly improved, and therefore, the process cartridge type is widely used in the electrophotographic field.

As shown in FIG. 23, the process cartridge 45 comprises a developing device frame 43 supporting a developing roller 18 and a toner accommodating container 46, which are welded with each other by ultrasonic welding. To the developing unit, a cleaning frame 47 which supports a photosensitive drum 11, a charging roller 12 and a cleaning blade 14, is coupled by a pin 49. A compression coil spring 42 is provided between the cleaner frame 47 and developing device frame 43. By this, the photosensitive drum 11 and the developing roller 18 are urged toward each other with spacer rollers therebetween.

In the electrophotographic image forming apparatus of the process cartridge type, there is a demand is for a large capacity developer (toner) accommodating container and a large removed toner container to extend the time period until the necessity of exchange of the process cartridge.

However, when the capacity of the developer accommodating container is increased, the weight of the developer increases. As a result, the loads imparted to the developing roller and the photosensitive drum are increased correspondingly.

Additionally, the loads change with consumption of the developer. Furthermore, the developer per se adjacent the developing roller 48 are influenced by the weight of the developer.

SUMMARY OF THE INVENTION

The present invention is directed to a solution to the problem.

Accordingly, it is a principal object of the present invention to provide a process cartridge and an electrophotographic image forming apparatus wherein the image quality is stabilized even if the accommodation capacity of the developer (toner) is increased.

It is another object of the present invention to provide a process cartridge, an assembling method for the process cartridge and an electrophotographic image forming apparatus in which the load imparted by the weight of a developer to a developing member and an electrophotographic photosensitive drum is reduced.

It is a further object of the present invention to provide a process cartridge, an assembling method for the process cartridge and an electrophotographic image forming apparatus in which the change in the load imparted by the weight of the developer to a process cartridge, the developing member, and the electrophotographic photosensitive drum, can be reduced.

According to an aspect of the present invention, there is provided a process cartridge detachably mountable to a main assembly of an electrophotographic image forming apparatus, comprising:

- a developing member for developing an electrostatic latent image formed on the electrophotographic photosensitive drum;
- a toner accommodation frame having an developer accommodating portion for accommodating a developer to be used by the developing member to develop the electrostatic latent image;
- a drum frame for supporting the electrophotographic photosensitive drum;
- a developing frame for supporting the developing member, the developing frame being swingably coupled with the toner accommodation frame;
- a first end cover connected with the drum frame and the developing frame at one longitudinal end of each of the drum frame and the developing frame; and
- a second end cover connected with the drum frame and the developing frame at the other longitudinal end of the drum frame and the developing frame.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described with reference to FIGS. 1–9.

In these embodiments, the term "longitudinal direction" refers to the direction which is perpendicular to the recording medium conveyance direction, and is parallel to the plane of the recording medium.

Figure 1:
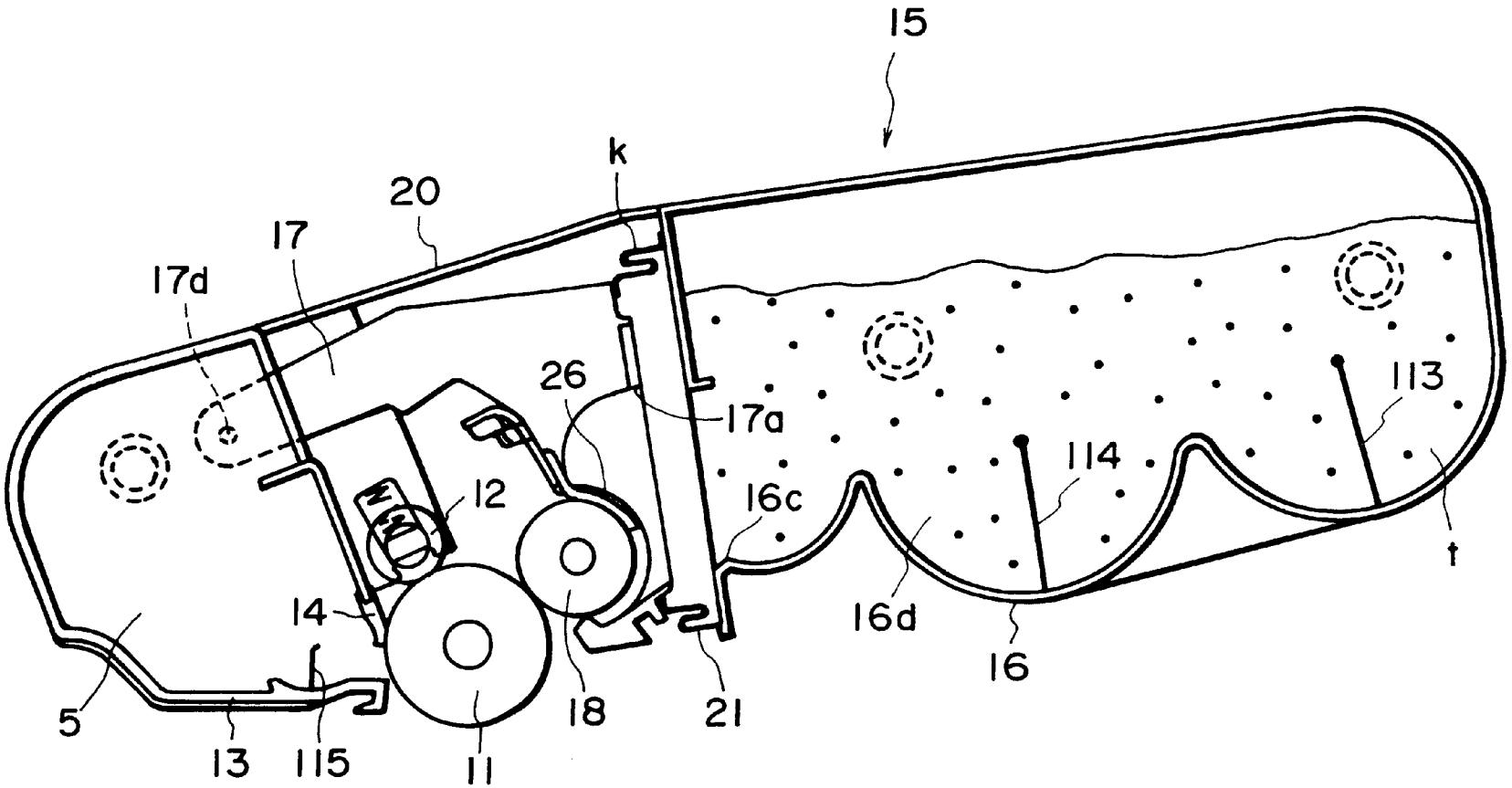
FIG. 1 is a sectional view of the process cartridge in the preferred embodiment of the present invention, at a plane perpendicular to the longitudinal direction of the cartridge.
Figure 2:
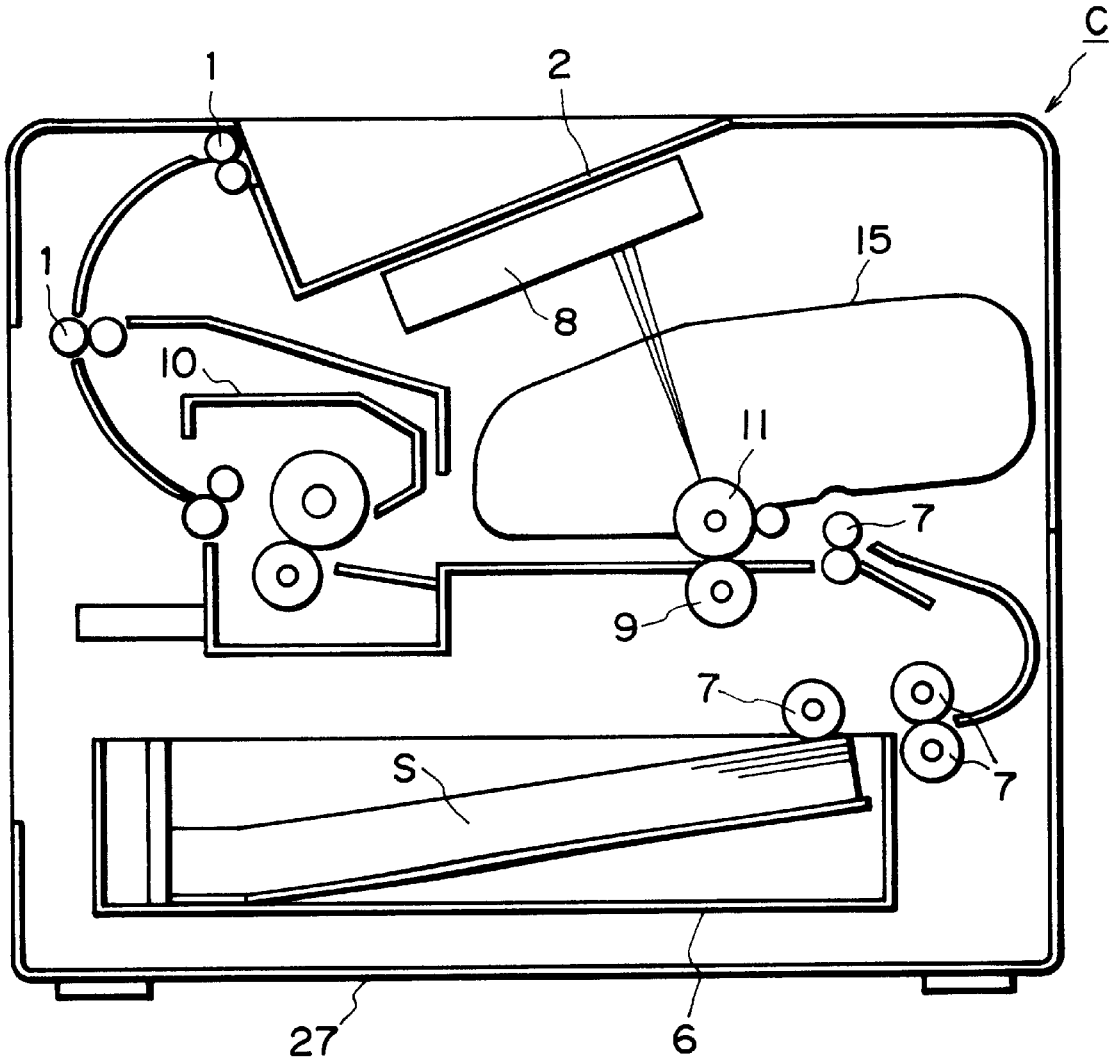
FIG. 2 is a schematic vertical sectional view of the image forming apparatus in the preferred embodiment of the present invention, at a plane perpendicular to the process cartridge.

Process Cartridge ad Main Assembly of Electrophotographic Image Forming Apparatus FIG. 1 is a sectional view of the essential portion of the process cartridge in accordance with the present invention. FIG. 2 is a sectional view of the essential portion of an image forming apparatus in accordance with the present invention. This process cartridge is provided with an electrophotographic photosensitive member, and a processing means that acts on the electrophotographic photosensitive member. The processing means can comprise for example, a charging means for charging the peripheral surface of the electrophotographic photosensitive member, a developing means for developing an electrostatic latent image formed on the electro-photographic photosensitive member, and a cleaning means for removing the toner remaining on the peripheral surface of the electrophotographic photosensitive member.

As shown in FIG. 1, the process cartridge 15 in this embodiment comprises: an electrophoto-graphic photosensitive member 11 (hereinafter, "electrophotographic photosensitive drum") in the form of a drum; a charge roller 12 as a charging member; a developing apparatus comprising a development roller 18 as a developing member, and a development blade 26; a cleaning blade 14 as a cleaning member; and a housing in which the preceding components are integrally disposed. The process cartridge 15 is removably installable in the main assembly 27 of an electrophotographic image forming apparatus (hereinafter, "apparatus main assembly").

The development roller 18 is a cylindrical member formed of metallic material such as aluminum, stainless steel, or the like, and contains a nonconducting magnetic roller (unillustrated).

Referring to FIG. 2, this process cartridge 15 is installed in an electrophotographic image forming apparatus C, for image formation.

A sheet S is fed out of a sheet cassette 6 in the bottom portion of the apparatus, by a conveyer roller 7. In synchronism with the conveyance of this sheet S, the photosensitive drum 11 is exposed by an exposing apparatus 8 according to the image data. As a result, an electrostatic latent image is formed on the photosensitive drum 11. Thereafter, the developer (hereinafter, "toner") stored in a toner storage container 16 is triboelectrically charged by a development blade 26, and this developer is borne on the peripheral surface of the development roller 18. Then, as development bias is applied to the development roller 18 as a developing member, the toner is supplied to the photosensitive drum 11. As a result, an image formed of toner (hereinafter, "toner image") is formed on the photosensitive drum 11, corresponding to the electrostatic latent image. Next, this toner image is transferred onto the sheet S, as a recording medium, by applying bias (voltage) to a transfer roller 9. Then, the sheet S is conveyed to a fixing apparatus 10, in which the toner image is fixed. Next, the sheet S is discharged by a discharge roller 1 into a delivery portion 2 provided on the top side of the apparatus. Meanwhile, the toner which remained on the photosensitive drum 11 after the image transfer is removed by a cleaning blade 14 as a cleaning member. The removed toner is moved rearward of a removed toner storage bin 5 by a removed toner conveying member 115. It should be noted here that prior to the above-described, photosensitive-drum exposure, the photosensitive drum 111 is charged by a charge roller as a charging member.

Structure of Process Cartridge Frame

Figure 3:
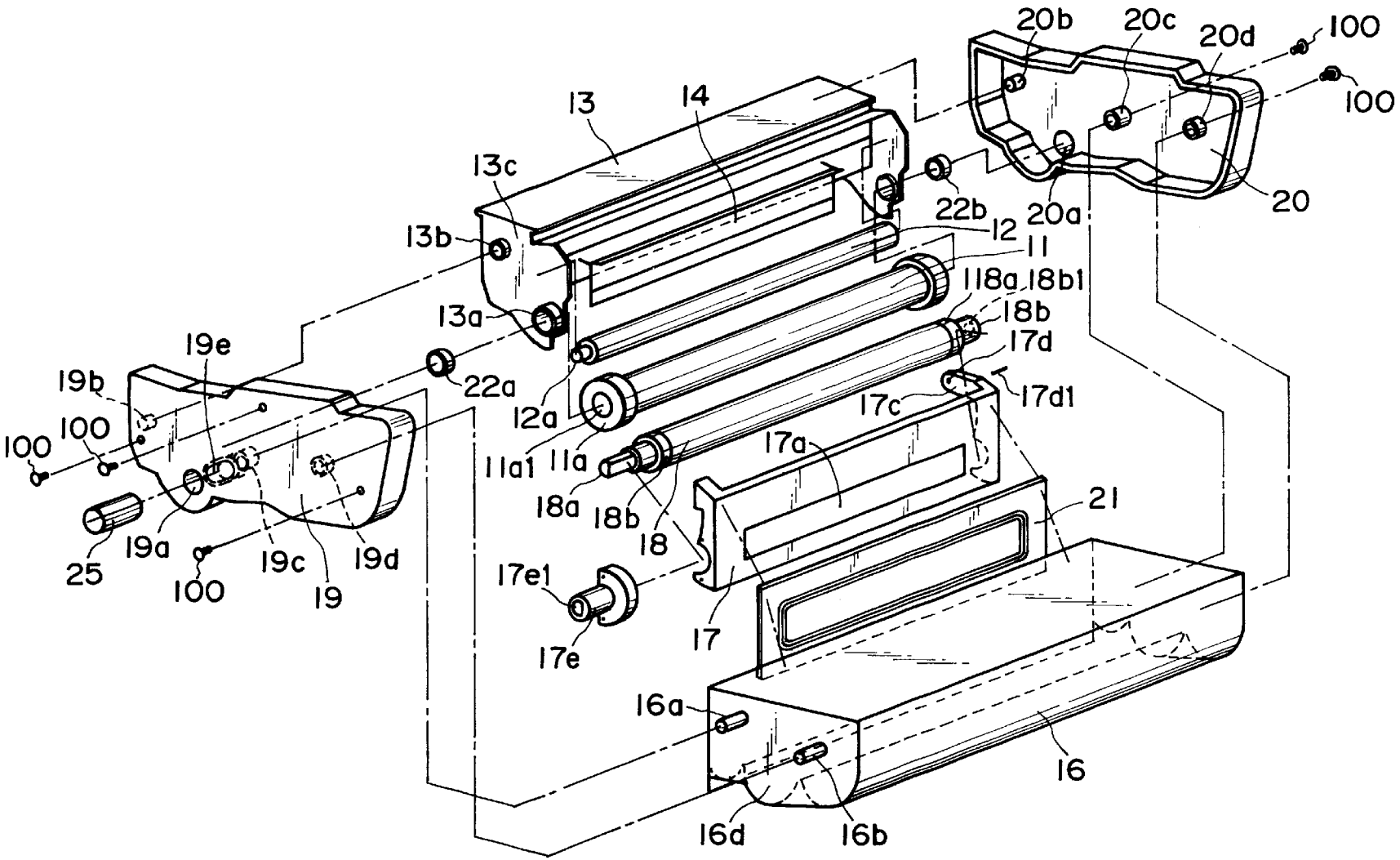
FIG. 3 is a schematic, perspective, and exploded view of the process cartridge in the preferred embodiment of the present invention, and depicts the general structure of the cartridge.
Figure 4:
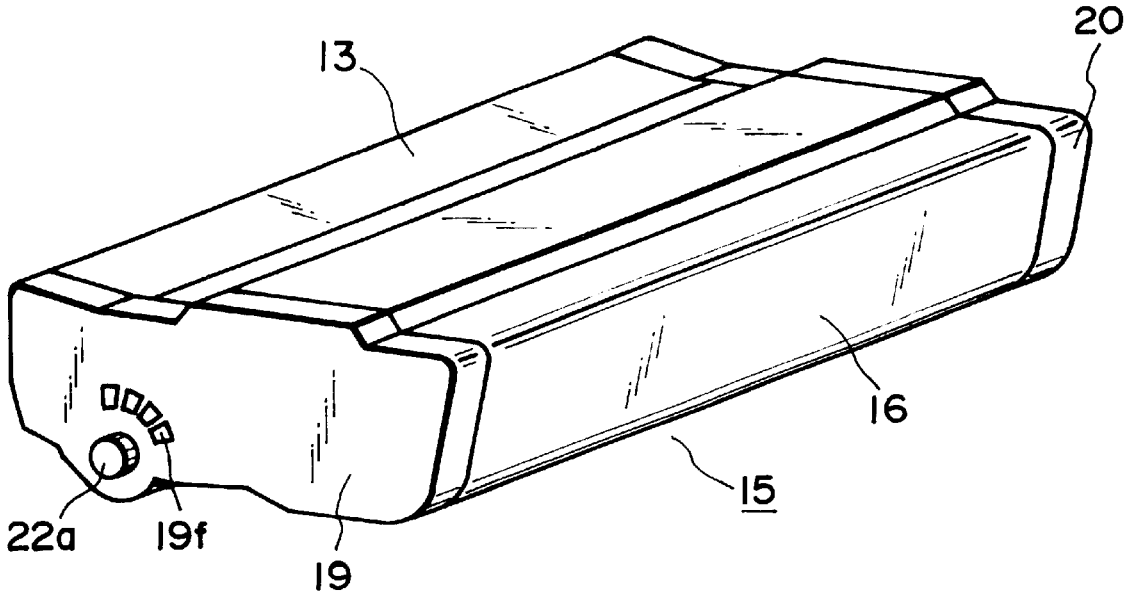
FIG. 4 is a schematic perspective view of the process cartridge in the preferred embodiment of the present invention, and shows the general structure of the cartridge.

FIGS. 3 and 4 are perspective views which show the structure of the process cartridge frame. FIG. 3 shows the process cartridge frame prior to its assembly, and FIG. 4 shows the process cartridge after its assembly.

The process cartridge 15 comprises three frame pieces: a cleaning-means frame 13 as a drum frame that integrally supports the photosensitive drum 11, a charge roller 12, and a cleaning blade 14; a developing-means frame 17 that integrally supports the development roller 18, and a development blade (unillustrated in FIG. 3, and designated by a reference code 26 in FIG. 4); and a toner-storage frame 16 provided with a toner-storage portion 16*d* in which toner is stored. Further, the process cartridge 15 in this embodiment comprises a pair of side covers 19 and 20 that are fixed to the longitudinal ends of the cleaning-means frame 13 and toner-storage frame 16 to hold the frames 13 and 16 together. The development-means frame 17 is supported by the cleaning-means frame 13.

To the cleaning-means frame 13, the cleaning blade 14 is fixed with the use of small screws. The charge roller 12 is rotatably supported by the longitudinal ends, by bearings (unillustrated). Referring again to FIG. 1, in the cleaning-means frame 13, the removed toner conveying member 115 for conveying the toner removed by the cleaning blade 14, into the removed toner bin 5, is rotatably disposed. In addition, in the cleaning-means frame 13, the photosensitive drum 11 is rotatably supported, with the flange portions, that is, the longitudinal end portions, of the photosensitive drum 11, supported by a pair of bearings 22*a* and 22*b*. The toner-storage frame 16 stores toner therein, and comprises a pair of toner conveying members 113 and 114 (FIG. 1) for conveying the stored toner toward the development roller 18. These toner conveying members may be provided with a toner stirring function.

The detailed description of the development means frame 17 will be given later.

The aforementioned side covers 19 and 20 are large enough to match in size the primary cross section (cross section at a plane perpendicular to the longitudinal direction of the photosensitive drum 11) of the process cartridge 15. They are positioned at the longitudinal ends of the process cartridge 15 (end portion in terms of the longitudinal direction of the photosensitive drum 11), one for one, covering, and being fixed to, both the cleaning-means frame 13 and the toner-storage frame 16. With this arrangement, the side covers 19 and 20 integrally hold together the cleaning-means frame 13 and the toner-storage frame 16. The holes 19*a* and 20*a* with which the side covers 19 and 20 are provided, respectively, are aligned with the rotational axis of the photosensitive drum 11 in the the cleaning-means frame 13. In the hole 13*a* of the side cover 19, that is, the side cover illustrated on the front side of the drawing, with which cleaning-means frame 13 is provided, the bearing 22*a* is press fitted. Also, a shaft 25 is put through the hole 19*a* of the side cover 19, the bearing 22*a*, and the center hole 11*a*1 of the flange 11*a*, to rotatably support one of the longitudinal encls of the photosensitive drum 11 by the cleaning-means frame 13. With this arrangement, the side cover 19 is precisely positioned by the bearing 22*a*, improving the accuracy in terms of the positional relationship of the side cover 19 with respect to the photosensitive drum 11. Further, a positioning member 19*b*, with which the side cover 19 is provided, and which is located so that its position becomes as far away as possible from the photosensitive drum 11 after the attachment of the side cover 19, is engaged with a positioning portion 13*b* with which the side wall 13*c* of the cleaning means frame 13 is provided. As a result, the position of the side cover 19, in terms of the rotational direction of the side cover 19 with respect to the center, or the axial line, of the photosensitive drum 11, is fixed. Then, the side cover 19 is fixed to the side wall 13*c*, that is, the wall at the longitudinal end, of the cleaning-means frame 13. The toner-storage frame 16 is provided with a pair of cylindrical positioning portions 16*a* and 16*b*, which project from one of the side walls 16*d*, that is, the wall at the longitudinal end, of the toner-storage frame 16, in the longitudinal direction of the toner-storage frame 16. These positioning portions 16*a* and 16*b* are fitted in the positioning portion 19*c* and 19*d*, that is, holes, respectively, with which the side cover 19 is provided, accurately positioning the toner-storage frame 16 relative to the side cover 19. Then, the toner-storage frame 16 and side cover 19 are fixed to each other. The other side cover 20 is similarly fixed to the toner-storage frame 16 and the cleaning-means frame 13, being accurately positioned relative to each other. The developing-means frame 17 is positioned using a method that will be described later. The bearings 22 (22*a* and 22*b*) double as members for positioning the process cartridge 15 relative to the apparatus main assembly 27.

Joining of Toner Storage Frame and Developing Means Frame

In order to supply toner from the toner-storage frame 16 to the development roller 18, the toner-storage frame 16 and the development-means frame 17 are provided with opening 16*c* (FIG. 1) and 17*a*. Further, the development-means frame 17 and the toner-storage frame 16 are joined with each other in such a manner that their internal spaces become connected to each other through the openings 17*a* and 16*c*, with a sealing means 21 as a flexible sealing means disposed between the two frames. As described above, the position of the toner-storage frame 16 is fixed relative to the side covers 19 and 20, whereas the position of the development-means frame 17 is fixed relative to the cleaning-means frame 13. Therefore, the frames 16 and 17 are attached to each other in a manner to allow them to pivot relative to each other to absorb the dimensional errors of the two frames. When installed into the apparatus main assembly 17, the position of the process cartridge 15 is fixed relative to the cartridge installation space of the apparatus main assembly 27, by the cleaning-means frame 13, which supports the photosensitive drum 11. The toner-storage frame 16 is substantially different in weight between the beginning of its usage when it contains toner, and the end of its usage when it is empty. Therefore, flexible material is used as the material for the sealing member 21. With this setup, even if a deformation occurs to the toner-storage frame 16, or one or both of the side covers 19 and 20, the deformation can be absorbed.

Figure 18:
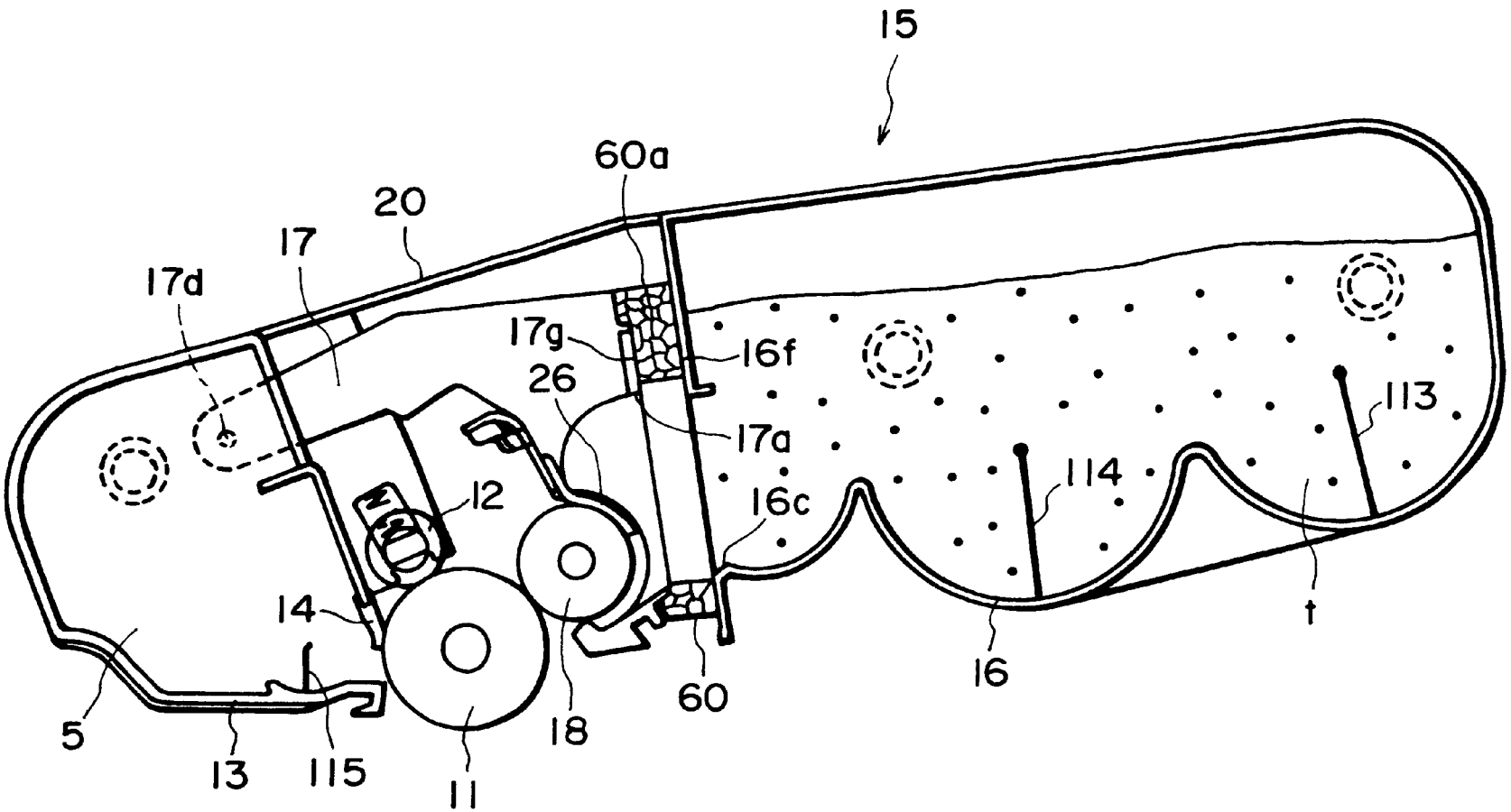
FIG. 18 is a vertical sectional view of the process cartridge in another embodiment of the present invention.

FIG. 18 is a vertical sectional view of a process cartridge equipped with a flexible sealing member different from the above described sealing member 21.

A sealing member 60 as a flexible sealing means is formed of elastic material such as foamed synthetic resin (for example, foamed urethane), rubber with a low degree of hardness, silicon rubber, or the like. This sealing member 60 is in the form of a piece of plate with a large opening 60*a*. After the installation of the sealing member 60, the opening 60*a* aligns with both the openings 17*a* and 16*c*. The size of the opening 60*a* is approximately the same as those of the openings 17*a* and 16*c*. The sealing member 60 is pasted to either to the surface of the development-means frame 17 or the surface of the toner-storage frame 16, which face each other, or both of the surfaces. The sealing member 60 is not pasted to the portion of the toner-storage frame 16, corresponding to the area through which the toner seal 24 is passed when the toner seal 24 is pulled out.

The thickness of the sealing member 60 is greater than the distance, after the completion of the assembly of the process cartridge 15, between the surface 17*g* of the developing-means frame 17 and the surface 16*f* of the toner-storage frame 16.

Therefore, after the completion of the assembly of the process cartridge 15, the sealing member 60 is compressed by the mutually facing surfaces 17*g* and 16*f* as shown in FIG. 18. The reactive force generated by the compression of the sealing member 60 acts as the pressure which keeps the spacer rollers 18*b* of the development roller 18 pressed upon the photosensitive drum 11. Therefore, the reactive force which the sealing member 60 generates is desired to be as small as possible.

With the provision of the above described structure, the load generated by the weight of the toner applies to the side covers 19 and 20, instead of applying to the development roller supported by the development means frame 17. Thus, the photosensitive drum 11 is not subjected to the load generated by the weight of the toner, and therefore, a stable image can be formed, even if the amount of the toner in the toner-storage frame 16 increases.

Structure of Developing Means Frame

Figure 5:
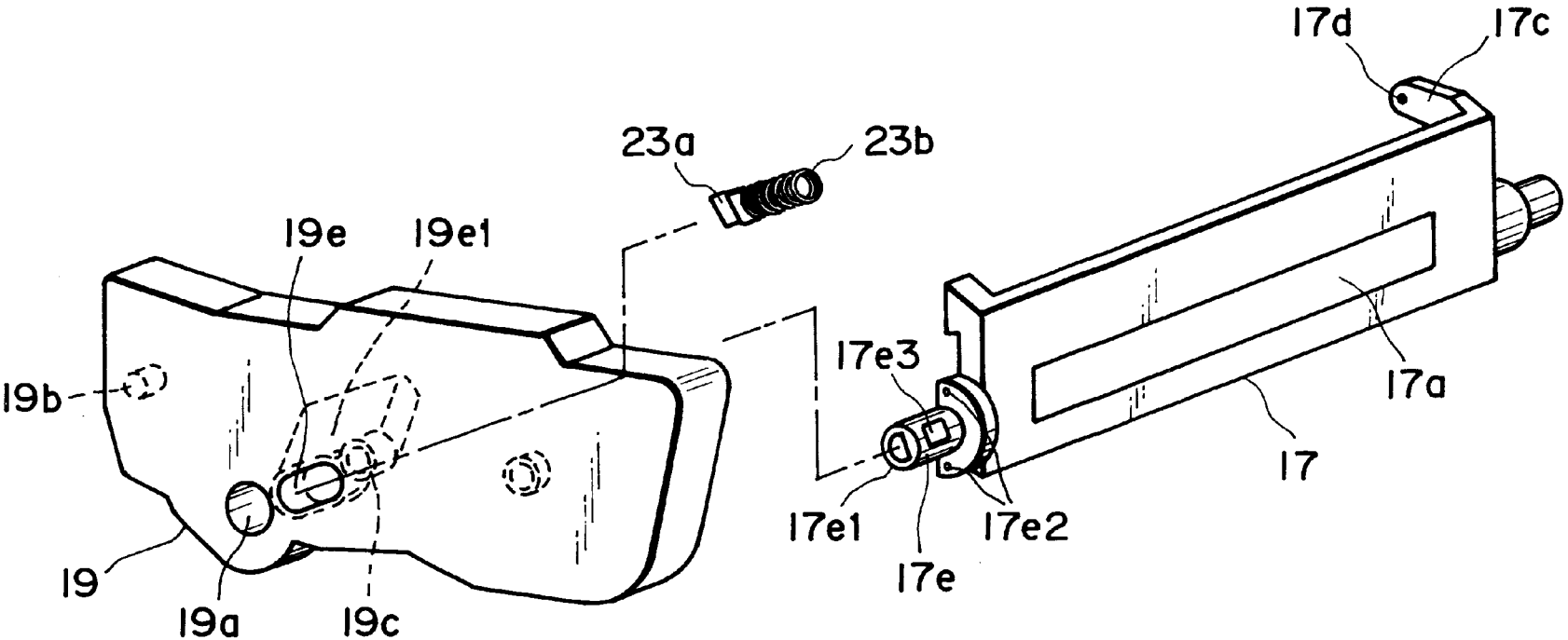
FIG. 5 is a schematic perspective view of a disassembled essential portion of the process cartridge in the preferred embodiment of the present invention.
Figure 6:
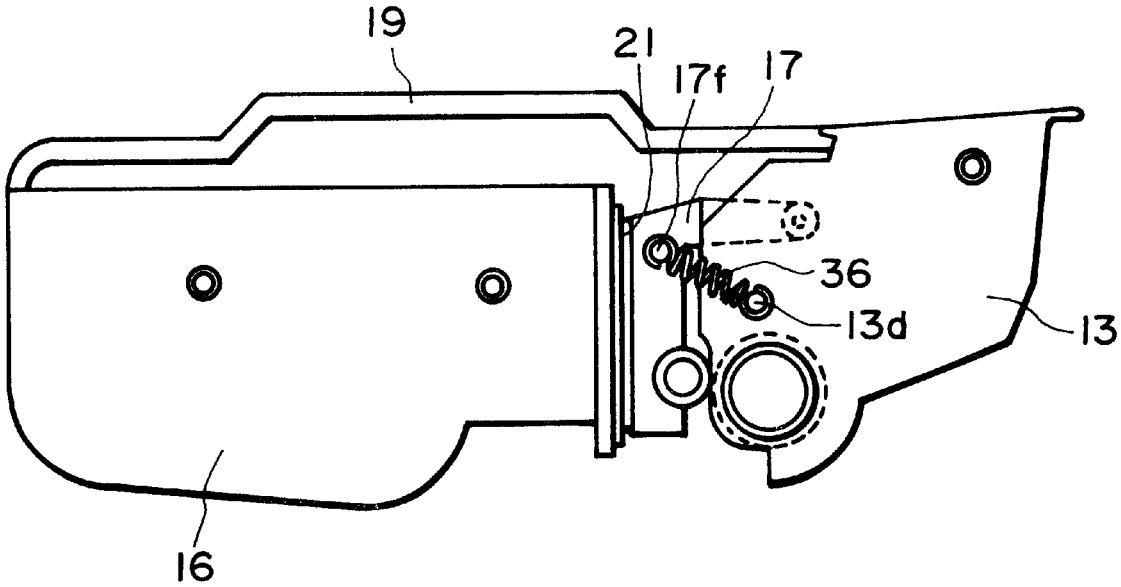
FIG. 6 is a schematic side view of the process cartridge in the preferred embodiment of the present invention.
Figure 7:
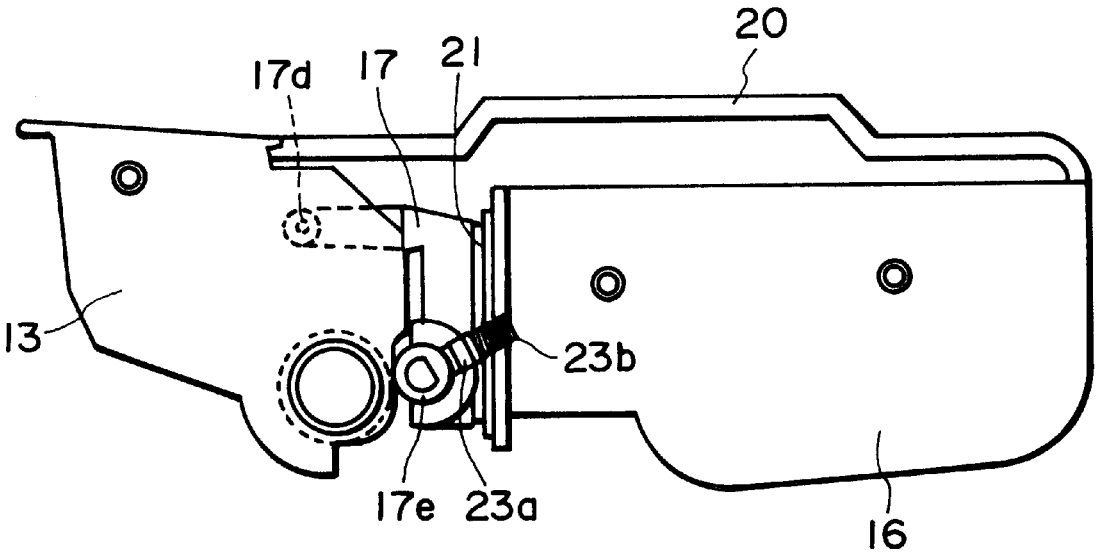
FIG. 7 is a schematic side view of the process cartridge in the preferred embodiment of the present invention.

Referring to FIGS. 3, 5, 6 and 7, the structure of the developing means frame will be described. FIG. 3 represents the state of the developing-means frame prior to assembly. FIGS. 5, 6 and 7 are drawings for describing the structure of the developing-means frame involved in the pressure application to the developing-means frame.

To the development-means frame 17, the development roller 18, which contains the magnetic roller 18*a*, the development blade 26 (FIG. 1), and a magnetic seal (unillustrated) are attached. A magnetic roller 18*a* is put through the longitudinal center hole of the development roller 18, and is nonrotationally supported by a developing-means frame 17, at each of the longitudinal ends. There is maintained a gap between the development roller 18 and magnetic roller 18*a*. The development roller 18 is rotationally supported by the developing-means frame 17, at each of the longitudinal ends. For the power supply to the development roller 18, electrical contacts are provided within the development roller 18. Further, both of the longitudinal end portions of the development roller 18 are fitted with a ring 18*b* (spacer rig) (FIG. 3) for maintaining a predetermined distance between the peripheral surfaces of the photosensitive drum 11 and development roller 18.

Figure 16:
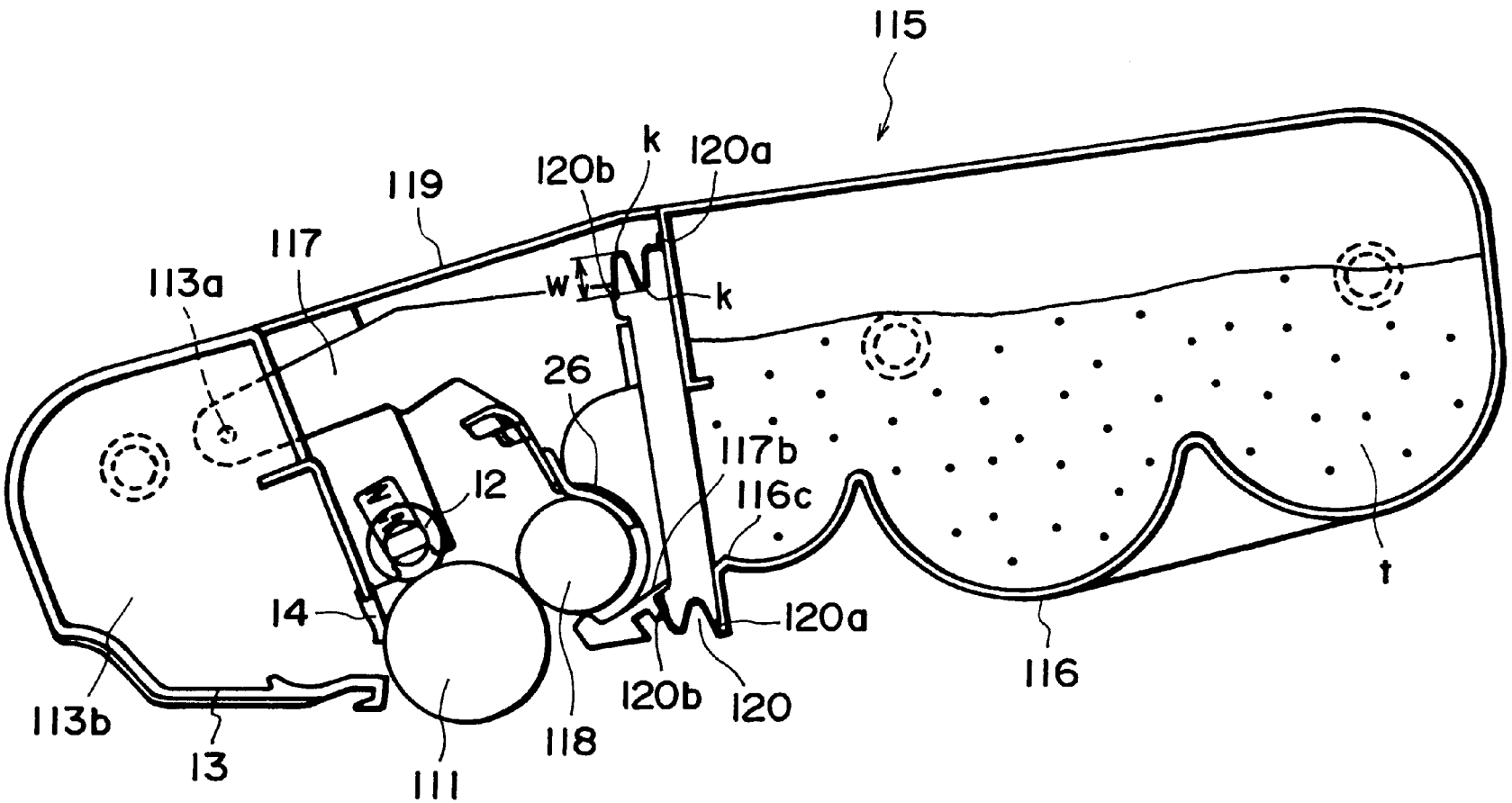
FIG. 16 is a vertical sectional view of the process cartridge in another embodiment of the present invention.

The developing-means frame 17 is provided with an arm portion 17*c*, which is on the driven side, that is, one of the longitudinal ends of the development roller 18, from which the development roller 18 is driven. The end portion of this arm portion 17*c* is provided with a hole 17*d*, the center of which functions as the pivotal center. The developing-means frame 17 is pivotally supported by a cleaning-means frame 13, in such a manner that the central axes of the photosensitive drum 11 and development roller 18 remain parallel to each other. More specifically, a pin 17*d*1 is fitted in the hole 17*d* of the development-means frame 17 and the hole (unillustrated) of the cleaning-means frame 13, so that the development-means frame 17 becomes pivotable about the center of the hole 17*d*. In addition, as described above, the cleaning-means frame 13 and toner-storage frame 16 are immovably fixed to each other. Thus, the development-means frame 17 is movable relative to the toner-storage frame 16. Next, referring to FIG. 16, the hooks of a tensional coil spring 36 are fitted around the spring anchoring projections 13*d* and 17*f* of the cleaning-means frame 13 and development-means frame 17, respectively, to provide such force that keeps the development roller 18 pressed toward the photosensitive drum 11, by their longitudinal ends. It should be noted here that in terms of the longitudinal direction of the photosensitive drum 11, the hole 17*d* is located on the driven side of the photosensitive drum 11. The drive side means the side by which the driving force is received when the process cartridge 15 is in the apparatus main assembly 27. The non-driven side means the side opposite to the driven side in terms of the longitudinal direction of the electrophotographic photosensitive drum 11.

Furthermore, the non-driven side of the developing-means frame 17 is provided with a projecting member 17*e*, which is fixed to the development-means frame 17 with the use of screws 17*e*2 and projects in the direction of the rotational axis of the development roller 18. This projecting member 17*e* is under the pressure which keeps it pressed toward the photosensitive drum 11 while keeping the rotational axes of the photosensitive drum 11 and development roller 18 parallel to each other. The longitudinal ends of the cleaning-means frame 13 and toner-storage frame 16, on the non-driven side, are covered with a side cover 19, which is attached thereto with the use of screws 100.

The longitudinal ends of the cleaning means frame 13 and toner storage 16, on the other side, or the driven side, are covered with a side cover 20, which is attached thereto with the use of screws 100 (FIG. 3).

Conversely, the cleaning-means frame 13 and toner-storage frame 16 are fixed to the side covers 19 and 20. Further, the development-means frame 17 is movable relative to the cleaning-means frame 13 and the toner-storage frame 16, with one of the longitudinal ends of the development-means frame 17 being supported by the cleaning-means frame 13 and the other being supported by the side cover 19.

Development Roller Pressing System

The end 17*e*1 of the projecting member 17*e* is inserted in a groove 19*e*, as a guiding portion, with which the side cover 19 is provided. The groove 19*e* extends toward the rotational axis of the photosensitive drum 11, allowing the projecting member 17*e* to move toward the rotational axis of the photosensitive drum 11. In the groove 19*e*, a compression coil spring 23*b* as an elastic member, and a slide piece 23*a* as a pressing member, slidable in the longitudinal direction of the groove 19*e*, are disposed so that pressure is applied to the projecting member 17*e* through the slide piece 23*a*.

Further, this groove 19*e* functions as a positioning member for regulating the direction in which the development roller 18 (developing means frame 17) is allowed to move. In other words, the development roller 18 is allowed to displace only in the direction parallel to the longitudinal direction of this groove 19*e*, since the moving direction of the projecting member 17*e* is regulated by the internal surface of the groove 19*e*.

As the process cartridge 15 receives a driving force from the apparatus main assembly 27, the force is applied to the gears 105*b* and 107*b* (FIG. 9), which are attached to the longitudinal ends of the photosensitive drum 11 and development roller 18, respectively, in a direction parallel to the central axis of the hole 17*e* to move the gears 105*b* and 107*b* so that they engage each other (it does not occur that the force is applied in the direction to separate the gears 105*b* and 107*b* from each other). In other words, the gears 105*b* and 107*b* are disposed so that the extension of the transverse line of action between the gears 105*b* and 107*b* runs adjacent to the hole 17d. Further, the center line of the hole 17*d* and the rotational axis of the photosensitive drum 11 are disposed on the same side with respect to the transverse line of action. Furthermore, the development roller 18 is under the force from the aforementioned compression coil spring 23*b*, being kept pressed toward the photosensitive drum 11.

The above description of this embodiment may be summarized as follows.

The process cartridge 15 removably installable in the main assembly 27 of an image Forming apparatus comprises: the electrophotographic photosensitive drum 11; the development roller 18 as a developing member for developing the electrostatic latent image formed on the electrophotographic photosensitive drum 11; the cleaning-means frame 13 as a frame for supporting the electrophotographic photosensitive drum 11; and the developing-means frames 17 for supporting the development roller 18. The developing-means frame 17 is provided with the projecting member 17*e*, which is attached to one of the longitudinal ends of the development roller 18, and projects in the longitudinal direction of the development roller 18. The projecting member 17*e* is fitted in the groove 19*e* as a guiding portion, being enabled to move in the groove 19*e* toward, or away from, the cleaning-means frame 13. The developing-means frame 17 is pivotally joined with the cleaning-means frame 13, at the other longitudinal end of the development roller 18. The development roller 18 is supported by the development-means frame 17, being enabled to move in the direction perpendicular to its rotational axis. The process cartridge 15 further comprises the compression coil spring 23*b* as an elastic member for generating such pressure that keeps the projecting member 17*e* pressed toward the cleaning-means frame 13 while allowing the projecting member 17*e* to move in the groove 19*e* in a direction perpendicular to the central axis of the projecting member 17*e*.

The groove 19*e* as a guiding member is provided with a recess 19*e*1, in which the end 17*e*1 of the projecting member 17*e* is fitted. Within the recess 19*e*1, the coil spring 23*b*, as an elastic member, is fitted in such a manner that the projecting member 17*e* is kept pressed toward the cleaning means frame 13 by the elastic force of the coil spring 23*b*. With this arrangement, the development roller 18 is pressed upon the electrophotographic photosensitive drum 11 with the interposition of a pair of spacer rollers 18*b* between the peripheral surfaces of the development roller 18 and the electrophotographic photosensitive drum 11. The spacer rollers are fitted around the longitudinal ends of the development roller 18, one for one.

To the end of the coil spring 23*b*, the slide piece 23*a* as a pressing member is attached. The slide piece 23*a* makes contact with the flat portion 17*e*3 of the projecting member 17*e*, pressing the projecting member 17*e* due to the elastic force of the coil spring 23*b*. The coil spring 23*b* is fitted in the groove 19*e*, being allowed to slide within the groove 19*e*.

The projecting member 17*e* is disposed so that its axial line approximately aligns with the rotational axis of the development roller 18.

The development-means frame 17 is rotationally supported by the cleaning-means frame 13, by the other longitudinal end of the development roller 18, at a position away from the rotational axis of the development roller 18 rotationally supported also by the developing-means frame 17, with the pin 17*d*1 fitted through the developing means frame 17 and cleaning-means frame 18.

Further, at the other longitudinal end of the development roller 18, the tension spring 36 is stretched between the development-means frame 17 and cleaning-means frame 13, with one end of the tension spring 36 attached to the development-means frame 17 and the other end attached to the cleaning-means frame 13.

The groove 19*e* is provided in the inwardly facing surface of the side cover 19, as a first side cover, attached to the longitudinal ends of the cleaning-means frame 13 and development-means frame 17, at each of their longitudinal ends.

It is necessary that the toner-storage frame 16 and development-means frame 17 are joined so that toner does not leak from the joint between the opening 16*c* of the toner-storage frame 16 and the opening 17*a* of the development-means frame 17. On the other hand, the development-means frame 17 and the toner-storage frame 16 need to be pivotable relative to each other. Therefore, in this embodiment, a sealing member 21, the size of which matches the size of the moving ranges of both opening portions, is placed between the opening portion of the toner-storage frame 16 and the opening portion of the development-means frame 17, to prevent the toner leakage. This sealing member 21 is pinched between the two opening portions, with the opening of the sealing member 21 aligning with the openings 16*c* and 17*a*. The sealing member 21 is desired to be shaped not to generate such force that impedes the movement of the development means frame 17; more specifically, it is provided with at least one fold, or it is in the form of a bellows. It is possible that the surface surrounding the opening 16*c* or 17*a* is provided with a groove which surrounds the opening, and in which an O-ring is fitted to seal the joint between the toner-storage frame 16 and the development-frames frame 17 while allowing the gap between the two frames to be variable.

In this embodiment, the sealing member 21 is formed of elastomer, and is provided with two folds (unillustrated), to reduce the overall resiliency of the sealing member 21. However, the material for the sealing member 21 does not need to be limited to the elastomer. It may be any material superior in flexibility, for example, foamed urethane, rubber with a low degree of hardness, silicone rubber, or the like. If the material used for the sealing member 21 is small in reactive force, the same effects at those obtained with the provision of the folds, that is, the shaping of the sealing member 21 in the form of a bellows, can be obtained without such provision or shaping.

Driving System

Figure 9:
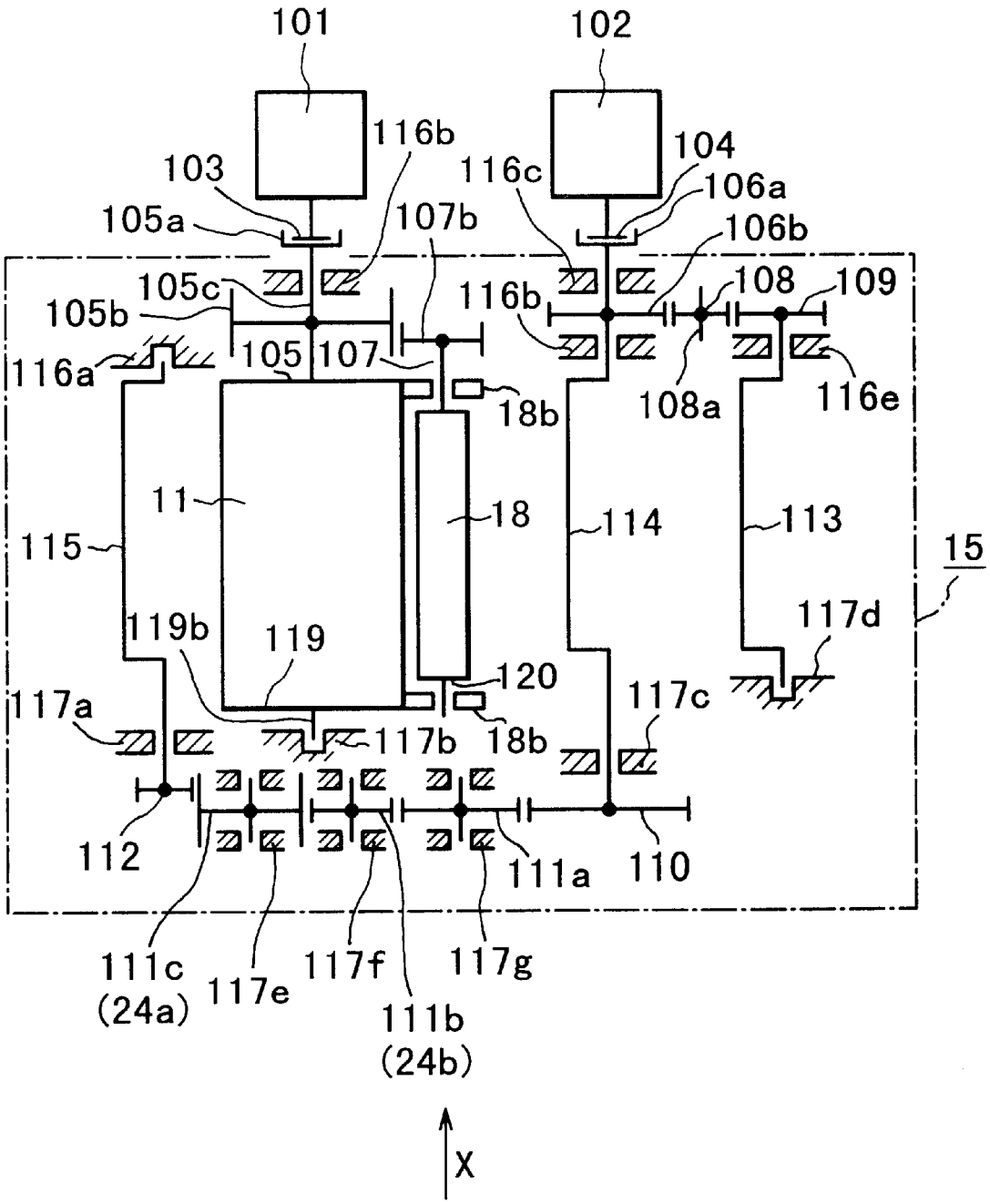
FIG. 9 is a diagram which depicts the driving system of the process cartridge in the preferred embodiment of the present invention.

FIG. 9 is a diagram which depicts the drive train in this embodiment.

An arrow mark X indicates the direction in which the process cartridge 15 is installed into the apparatus main assembly 27.

The driving force sources 101 and 102 (for example, an electric motor) provided in the apparatus main assembly 27 are connected to couplings 103 and 104. As the process cartridge 15 is installed into the apparatus main assembly 27, the couplings 103 and 104 are engaged with couplings 105*a* and 16*a*, respectively, with which the process cartridge 15 is provided. The couplings 105*a* and 106*a* rotate with the input gears 105*b* and 106*b*, respectively. The coupling 106*a* is supported by a bearing 116*c*. The coupling 105*a* is integral with the gear 105*b*, or is an integral part of a gear flange 105. The gear flange 105 is supported by a bearing 116*b*.

Next, the driving system of the process cartridge will be described.

To one of the longitudinal ends of the photosensitive drum 11, the gear flange 105 is fixed. To one of the longitudinal ends of the development roller 18, a gear flange 107 is fixed. The gear flanges 105 is integrally formed with the gear 105*b*. Similarly, the gear flange 107 is integrally formed with the gear 107*b*. To the other longitudinal end of the photosensitive drum 11, a bearing flange 119 is fixed, and to the other longitudinal end of the development roller 18, a bearing flange 120 is fixed. The photosensitive drum 11 are development roller 18 being to their own units. The gear 105*b* is in mesh with the sleeve gear 107*b*.

As the coupling 103 is rotated by the driving force from the driving force source 101 provided in the apparatus main assembly 27, the photosensitive drum 11 and development roller 18 are rotated. The photosensitive drum unit is rotationally supported by the bearings 116*b* and 117*b*. The development roller 18 is rotationally supported by the development-means frame 17. Further, the development roller 18 is rotated while maintaining an optimal gap, which is provided by the aforementioned spacer rollers 18*b*, from the peripheral surface of the photosensitive drum 11. The bearings 116*b* and 117*b* are the surfaces themselves of the holes with which the cleaning-means frame 13 is provided, or the bearings 22 (FIG. 3) fixed to the cleaning-means frame 13. In the bearings 116*b* and 117*b*, the journal portions 105*c* and 119*b* of the flanges 105 and 109, respectively, are fitted.

Next, the driving of toner conveying members 113 and 114 will be described.

To the toner conveying member 114, a driving force is transmitted from the input gear 106*b*. The toner conveying member 114 is directly connected to the shaft of the gear 106*b*. The driving force is transmitted to the toner conveying member 113 through an idler gear 108 meshed with the input gear 106*b*, and a toner conveyance gear 109 meshed with the idler gear 108. The idler gear 108 is rotationally supported by the shaft 108*a*. Thus, as the input gear 106*b* rotates, the toner conveyance gear members 114 and 113 follow the rotation of the input gear 106*b* because their journal portions are rotationally supported by the bearings 116*b* and 116*e*, and the bearings 117*c* and 117*d*, respectively.

Further, in a removed toner bin 5, with which the cleaning means frame 13 is provided to collect the removed toner, a feather-shaped toner conveying member 115 for conveying the toner removed from the photosensitive drum 11 is disposed. This removed toner conveying member 115 is rotationally supported by the cleaning means frame 13, with the use of bearings 116*a* and 117*a*. To one of the longitudinal ends of the toner conveying member 115, an input gear 112 fixed. This gear 112 is indirectly meshed with an output gear 110, through idler gears 111*c*, 111*b* and 111*a*.

To the other longitudinal end (non-driven side) of the toner conveying member 114, the output gear 110 is fixed. The idler gears 11*a*, 11*b* and 11*c* are rotationally supported by the bearing portions 117*e*, 117*f*, 117*g*, by their shaft portions. Thus, as the toner conveying member 114 rotates, the removed toner conveying member 115 follows the rotation of the toner conveying member 114. In other words, the driving force received by the gear 106*b* is transmitted to the other longitudinal end of the toner conveying member through the toner conveying member 114. Then, it is transmitted to the conveying member 115 through the gears 111*a*, 111*b*, 111*c* and 112, at the other longitudinal end (on the non-driven side). The above positional arrangement of the components of the driving system assures that the driving force is efficiently delivered to both the driven and non-driven sides through the driving system.

As described above, the transmission of the driving force throughout the process cartridge 15 is separately shared by a driving system for transmitting the driving force to the photosensitive drum 11 and development roller 18, and another driving system for transmitting the driving force to the toner conveying members and removed toner conveying members, to which the driving force is delivered from the driving force source 101 and 102, respectively.

In addition to the above described structural arrangement, according to which the driving force is transmitted from the output portion of the toner conveying member 114 to the removed toner conveying member 115, the following arrangements are conceivable: (1) the removed toner conveying member 115 is driven by transmitting the driving force by way of the toner conveying member 113 with the provision of the similar structure; (2) the removed toner conveying member 115 is driven by transmitting the driving force by way of any of the input gears 106*b* and 109, and the idler gear 108, through the gear trains; or (3) the removed toner conveying member 115 is driven by an idler gear attached to the end of the shaft of the idler gear 108 extended to the non-driven side.

The above described embodiment may be summarized as follows.

The process cartridge 15 removably installable in the main assembly 27 of an electrophotographic image forming apparatus comprises: the electrophotographic photosensitive drum 11; the development roller 18 as a developing member for developing the electrostatic latent image formed on the electrophotographic photosensitive drum 11; the toner-storage portion 16*d* as a developer storage portion for storing the developer t used for developing the electrostatic latent image; the toner conveying members 113 and 114 as a developer conveying member for conveying the toner t stored in the toner-storage portion 16*d*, toward where the development roller 18 is disposed; a combination of the coupling 105*a* and input gear 105*b* as the first driving force transmitting means for receiving the driving force for rotating the electrophotographic photosensitive drum 11 from the apparatus main assembly 27 and transmitting the received driving force to the electrophotographic photosensitive drum 11, as the process cartridge 15 is installed into the electrophotographic photosensitive member main assembly 27; and a combination of the coupling 106*a* and input gear 106*b* as the second driving force transmitting means for receiving the driving force for driving the toner conveying member from the apparatus main assembly 27 and transmitting the received driving force to the toner conveying member, as the process cartridge 15 is installed into the electrophotographic image forming apparatus main assembly 27, wherein the driving system for driving the coupling 106*a* and gear 106*b*, and the driving system for driving the coupling 105*a* and gear 106*b*, are independent from each other.

The position at which the coupling 105*a* and coupling 106*a* receive the driving force from the apparatus main assembly 27 is the leading end of the process cartridge in terms of the direction in which the process cartridge 15 is installed into the apparatus main assembly 27, provided that the process cartridge 15 is installed into the apparatus main assembly 27 in the direction parallel to the longitudinal direction of the electrophotographic photosensitive drum 11.

Further, the process cartridge 15 comprises the cleaning blade 114 as a cleaning member for removing the developer remaining on the electro-photographic photosensitive drum 11, and the removed toner conveying member 115 as a removed developer conveying member for conveying the developer removed from the electrophotographic photosensitive drum 11 by the cleaning blade 114. The removed toner conveying member 115 is rotated by the driving force which the coupling 106*a* received from the apparatus main assembly 27.

The driving force which the coupling 106*a* received from the apparatus main assembly 27 is transmitted to the other longitudinal end of the toner conveying member 114 through the toner conveying member 114, and then, is transmitted to the removed toner conveying member 115, at the other longitudinal end of the toner conveying member 114.

At the other longitudinal end of the toner conveying member 114, the plurality of gears 111*a*, 111*b*, 111*c* and 112 are disposed, and the driving force which was transmitted to this side through the toner conveying member 114 is transmitted to the removed toner conveying member 115 through the plurality of gears 111*a*, 111*b*, 111*c* and 112.

The driving force which the coupling 105*a* received from the apparatus main assembly 27 is transmitted to the development roller 18 through the gear 107*b*. By this driving force, the development roller 18 is rotationally driven. Further, as the process cartridge 15 is installed into the apparatus main assembly 27, the coupling 106*a* as the aforementioned cartridge coupling engages with the coupling 104 as the main assembly coupling of the apparatus main assembly 27 to receive the driving force, whereas the coupling 105*a* as the aforementioned cartridge coupling engages the coupling 103 as the main assembly coupling of the apparatus main assembly 27 to receive the driving force.

The apparatus main assembly 27 is provided with the coupling 103 as the first driving force transmitting member of the main assembly, and the coupling 104 as the second driving force transmitting member of the main assembly.

With the provision of the above structural arrangement, it does not occur that the rotational irregularity and vibration of the driving system involved in the conveyance of the toner for development, and the removed toner, are directly transmitted to the driving system for rotationally driving the photosensitive drum and development roller directly involved in image formation. Therefore, it is possible to prevent the formation of an image which suffers from irregularities traceable to pitch irregularity or vibration, or blurring.

In particular, as the capacity of the toner storage container is increased (for example, to a capacity equivalent to the amount of toner sufficient to produce approximately 30000 A4 type standard copies), the amount of load that is applied to the system for driving the toner conveying member increases. Further, there is a possibility that as the number of the toner conveying members is increased to three, four, and so on, it becomes easier for the irregularities traceable to driving force transmission to occur. Thus, a driving system structure such as the above described one in which the driving system is divided into a plurality of sub-systems is advantageous.

Further, with the increase in the capacity of the toner storage container, the load that is applied to the removed toner conveying member also increases. Also, the driving system in which the driving system is divided into a plurality of sub-systems becomes advantageous as the cleaning-means frame becomes virtually filled up with the removed toner.

Furthermore, the driving force input system for driving the removed toner conveying member and the driving force input system for driving the developmental toner, are integrated into a single unit, simplifying the structure of the coupling for connecting the apparatus main assembly and the process cartridge, which in turn makes it easier to arrange the gears and the like, providing an advantage from the viewpoint of space saving.

Conventionally, the toner conveying system and toner stirring system are driven by directly meshing the gear of the development roller with the gears of the toner conveying system and toner stirring system. However, in this embodiment, such direct engagement between the gears of the former and latter does not occur. Therefore, even if the load that is applied to the toner conveying system and toner stirring system increases due to the increase in the toner storage container capacity, it is unnecessary to increase the strength of the gears 105*b* and 107*b* for driving the development roller 18. Therefore, it is possible to use low module gears for driving force transmission. With this arrangement, it does not occur that an image suffering from the aforementioned irregularities is produced due to the irregularity in the pitch that occurs as the drum gear 105*b* and sleeve gear 107*b* mesh with each other.

Further, in this embodiment the cleaning-means frame and the toner-storage frame are integrally fixed to each other by the side covers. Therefore, the removed toner conveying member and developmental toner conveying member can be precisely connected and driven.

Further, only the developing means frame which supports the developing member such as the development roller is pivotally supported so that it is enabled to pivot following the photosensitive drum. Therefore, it is easy to connect the drum gear 105*b* and sleeve gear 107*b* to each other by driving them.

The force for rotationally driving the removed toner conveying member 115 is transmitted from the driving system for driving the toner conveying member. Therefore, even when the photosensitive drum is rotated at a high velocity, it is easy to continue to convey the removed toner at the conventional rotational velocity.

Structure of Air Passage for Cooling

Figure 8:
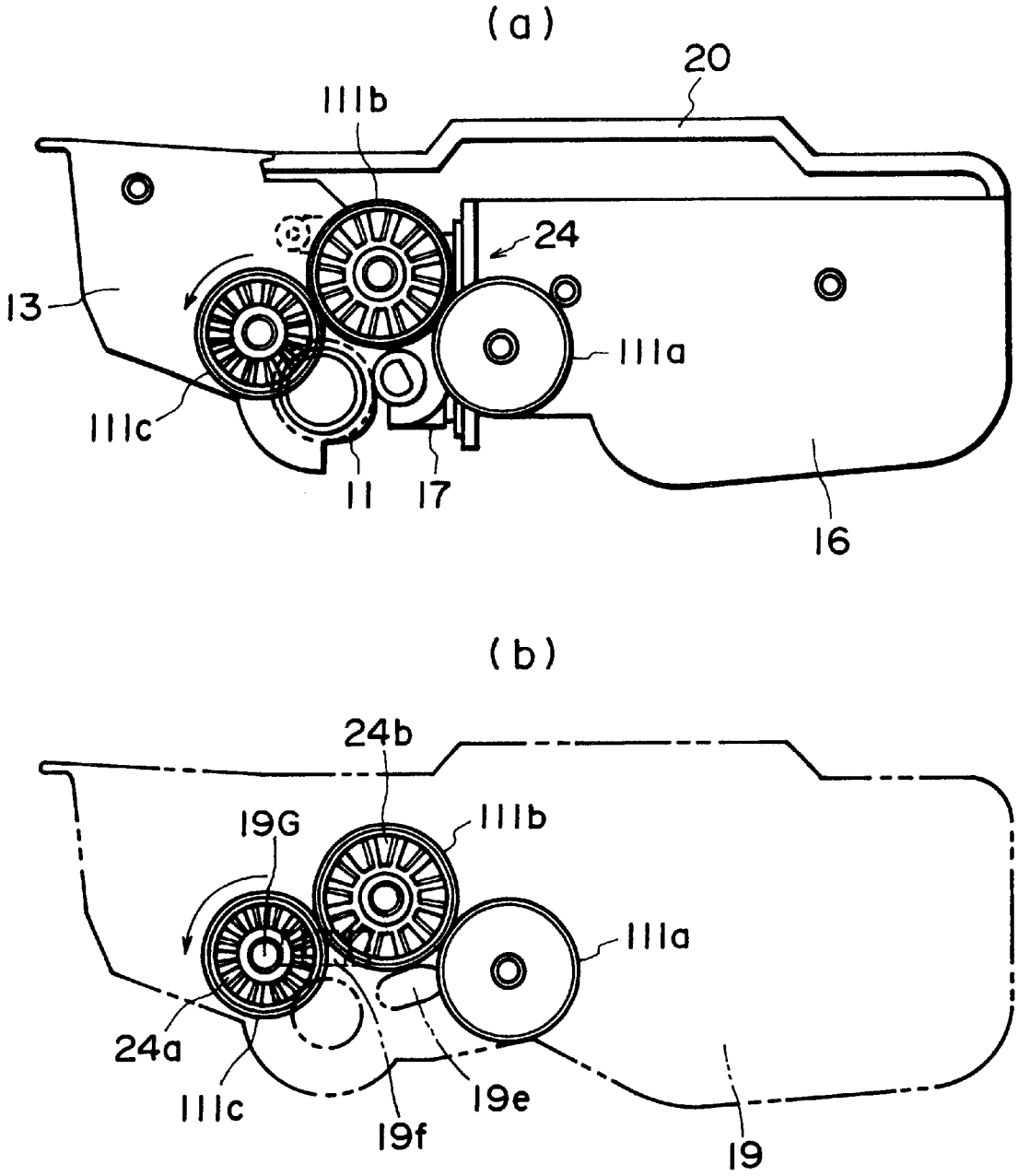
FIGS. 8*a* and 8*b* are schematic side views of an essential portion of the process cartridge in the preferred embodiment of the present invention.

FIG. 8 is a schematic drawing of the gear train positioned along the photosensitive drum. FIG. 8, (*a*) is a side view of the process cartridge, with the side cover removed, and FIG. 8, (*b*) is a side view of the process cartridge, in which the contour of the side cover is indicated by an imaginary line. Within the cleaning means frame 13, the conveying member 115 for conveying the recovered removed toner toward the rear of the removed toner bin 5 is disposed. When the structural arrangement of the process cartridge 15 is such that the conveying member 115 receives the driving force from photosensitive drum 11, and the rotational velocity must be reduced by a large ratio. However, if the arrangement is such that the driving force is transmitted from the toner conveying member 114, the velocity reduction by a large ratio is unnecessary. Therefore, it is easy to attain a proper rotational velocity. In this case, the gears 111*b* and 111*c* are disposed in the adjacencies of the photosensitive drum 11, penetrating the toner storage frame 16 and developing-means frame 17 (FIG. 8 (*a*)).

In this embodiment, in order to prevent the temperature increase in the adjacencies of the photosensitive drum, it is assured that an air passage 19*f* is secured in the side cover 16, in the adjacencies of the photosensitive drum (FIG. 8 (*b*)). More specifically, the gear 111*b* and 111*c* are provided with a plurality of slits 24*a* and 24*b*, respectively, the interval portions of which form a plurality of axial flow vanes, to forcefully exhaust, or take in, the air through an air passage 19*b*. With this arrangement, it does not occur that the air passage 19 for cooling the interior is blocked by the gears 111*b* and 111*c*.

Figure 20:
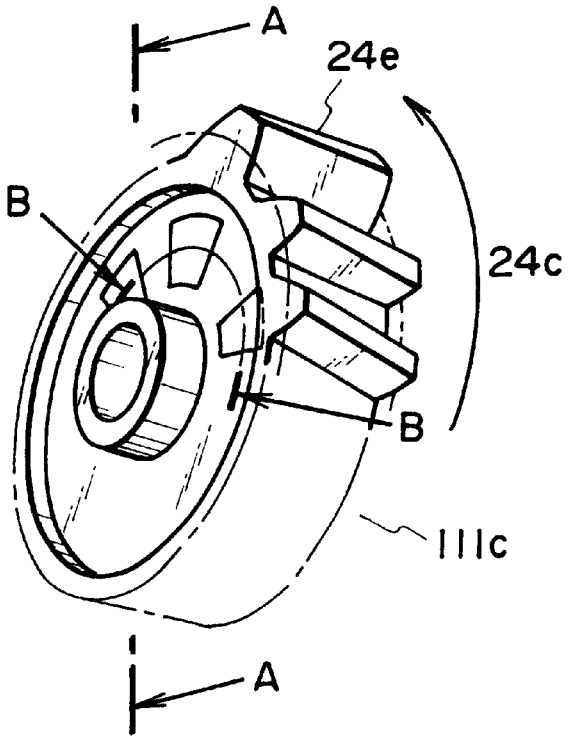
FIG. 20 is a perspective view of the impeller equipped gear of the process cartridge.
Figure 21:
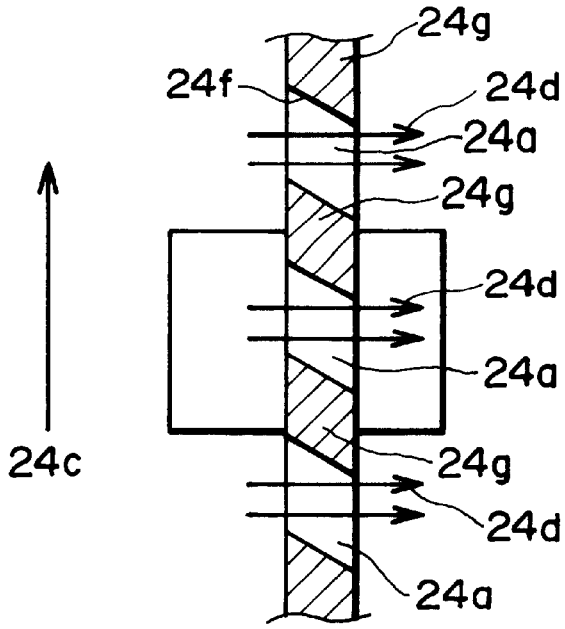
FIG. 21 is a sectional view of the impeller equipped gear, at a plane B—B in FIG. 20.
Figure 22:
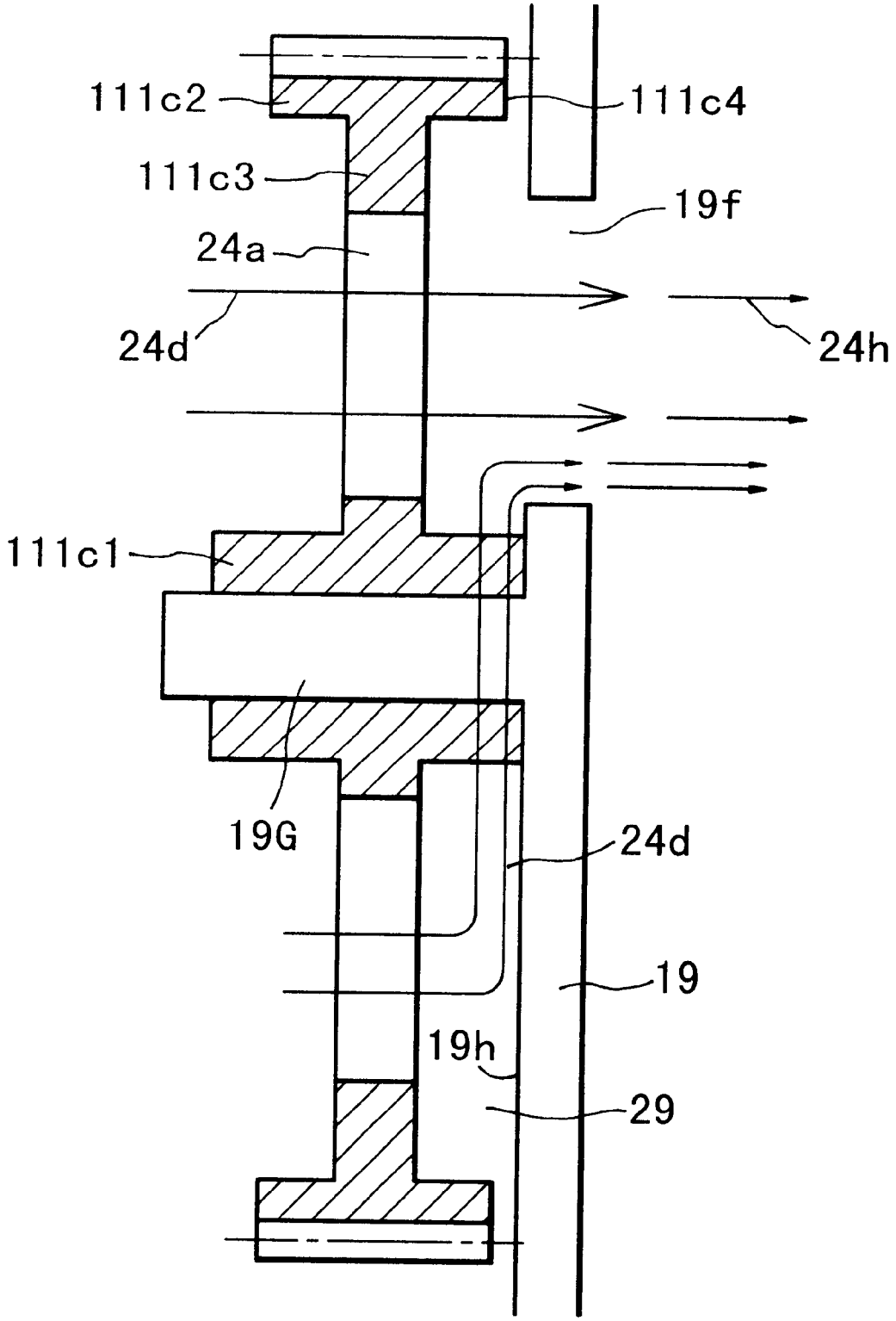
FIG. 22 is a sectional view of the impeller equipped gear, at a plane A—A in FIG. 20.
Figure 23:
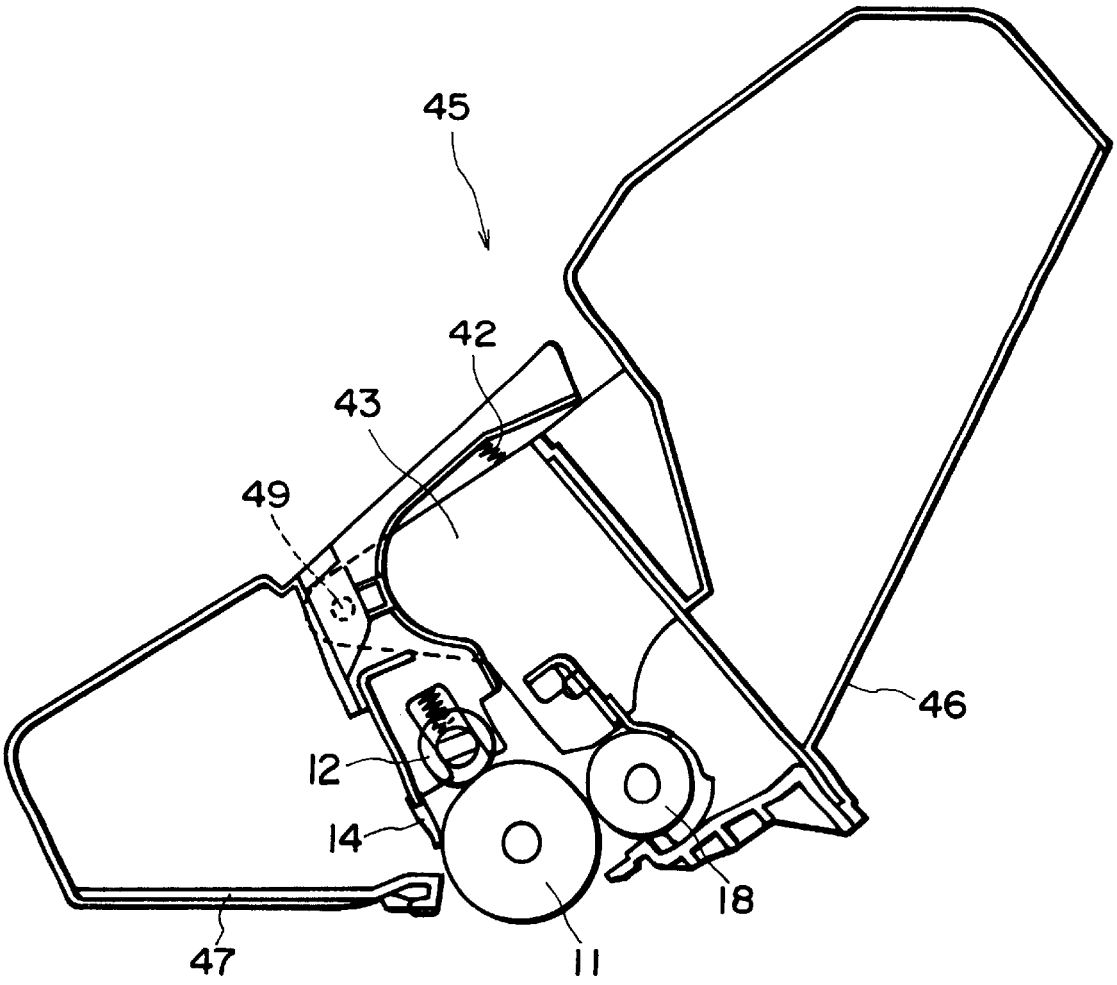
FIG. 23 is a vertical sectional view of an example of a conventional process cartridge.

Next, referring to FIGS. 20, 21 and 23, the structure of the cooling air passage will be described. FIG. 20 is a perspective view of the gear 11*c*. The structure of the gear 111*b* is the same as that of the gear 111*c*, except that the former is opposite to the latter in the direction of the helical teeth, and the direction of the helical air passages. Therefore, the air passage structure is described referring to the gear 111*c* as an example. FIG. 21 is a development of the section of the B—B portion of the gear 111*c* illustrated in FIG. 20, at a cylindrical plane perpendicular to the rotational axis of the gear 111*c*, and FIG. 22 is a sectional view of the gear 111*c* illustrated in FIG. 20, at a plane A—A.

The gear 111*c* is a helical gear. In a disk portion 111*c*3, which connects the rim portion 11*c*2 comprising the helical teeth, and the hub portion 111*c*1, a plurality of through slits 24*a* are provided, which extend in the radial direction of the gear 111*c*, at equal intervals. There is also provided a certain amount of distance between the surface of the disk portion 111*c*3 and the inwardly facing surface 19*h* of the side cover 19. Thus, the air passage 19*f* of the side cover 19 and the slits 24*a* are rendered continuous through the space 29. The gear 111*c* is rotationally supported by a shaft 19G, which extends inward from the inwardly facing surface of the side cover 19, perpendicular to the longitudinal direction of the photosensitive drum 15; the shaft 19G is put through the center hole of the hub 111*c*1. The end portion of the shaft 19G is fitted with a retainer ring (unillustrated) to prevent the gear 111*c* from moving in the shaft direction. The outwardly facing surface 111*c*4 of the rim portion 111*c*2 is very close to the inwardly facing surface 19*h* of the side cover 19. The inwardly facing surface 19*h* of the side cover 19, and the outwardly facing surface 111*c*4 of the rim portion, are required to make the amount of the air flow between them as small as possible. Thus, they may be intricately formed in such a manner that the gap between them forms a labyrinth.

The length and position of each slit 24*a* in terms of the radial direction of the gear 111*c* matches those of the air passage 19*f*.

Referring to FIG. 21, the interval between the adjacent two slits 24*a* is occupied by a helical vane 24*g*; the adjacent two slits 24*a* are separated by a helical vane. The slit 24*a* is desired to be shaped like an interval space between adjacent two vanes of an axial flow fan so that the gear 111*c* is rendered aerodynamically effective in moving air. However, the gear 111*c* is relatively slow in rotational velocity, and therefore, the vanes of the gear 111*c* may be simply angled. With the provision of these slits 24*a*, the disk portion 111*c*3 of the gear 111*c*, that is, the portion of the gear 111*c* on the inward side of the rim 111*c*2 in terms of the radial direction of the gear 111*c*, constitutes an impeller.

Referring to FIGS. 20 and 21, as the gear 111*c* rotates in the direction indicated by an arrow mark 24*c*, air flows in the axial direction as indicated by an arrow mark 24*d*. Then, the air moves toward the air passage 19*f* through the space 29, and is exhausted out of the process cartridge 15 through the air passage 19*f* of the side cover 19.

As is evident from the drawings, the cooling air passage is structured so that the air currents from all the slits 24*a* are allowed to simultaneously flow through the space 29. Therefore, all the vanes 24*d* contribute to the generation of the air flow.

If the direction of the surface 24*f* of the vane 24*g* is reversed, the direction of the air flow reverses even if the rotational direction of the gear 111*c* is kept the same. Thus, the direction of the surface 24*f* should be determined to be advantageous in terms of cooling efficiency, in consideration of the positional arrangement of the components, and the general configuration of the cooling air passage.

The twist angle of teeth 24*e* of the helical gear 111*c* is rendered parallel to the twist angle of the surfaces 24*f* of the vanes 24*g*. With this arrangement, the teeth 24*e* and vanes 24*g* become the same in terms of the air flow in the axial direction of the gear 111*c*. Further, such an arrangement is advantageous in terms of mode formation, in a case that the gear 111*c* is molded of resin. In a case that the teeth 24*e* and vanes 24*g* of the gear 111*c* are constructed so that they become the same in terms of in which direction they send air in terms of the axial direction of the gear 111*c*, a gap for allowing the air to pass is provided between the outwardly facing surface of the rim 111*c*2 and the inwardly facing surface of the side cover 119. Also, a cover which follows the peripheral surface of the gear 111*c*, except for the portion where the gear 111*c* meshes with its counterpart, is provided as a member which functions like the casing of an air blower.

As described above, during an image forming operation, the gears 111*b* and 111*c* rotate, and therefore, the internal space of the process cartridge 15 is ventilated. Also, the heat generated by the fixing apparatus and the like is removed. Further, the apparatus main assembly 27 is provided with ventilation holes through which the apparatus main assembly 27 is naturally ventilated, or ventilating means such as a fan (unillustrated), or the like is provided.

Other Embodiments of Process Cartridge

Figure 10:
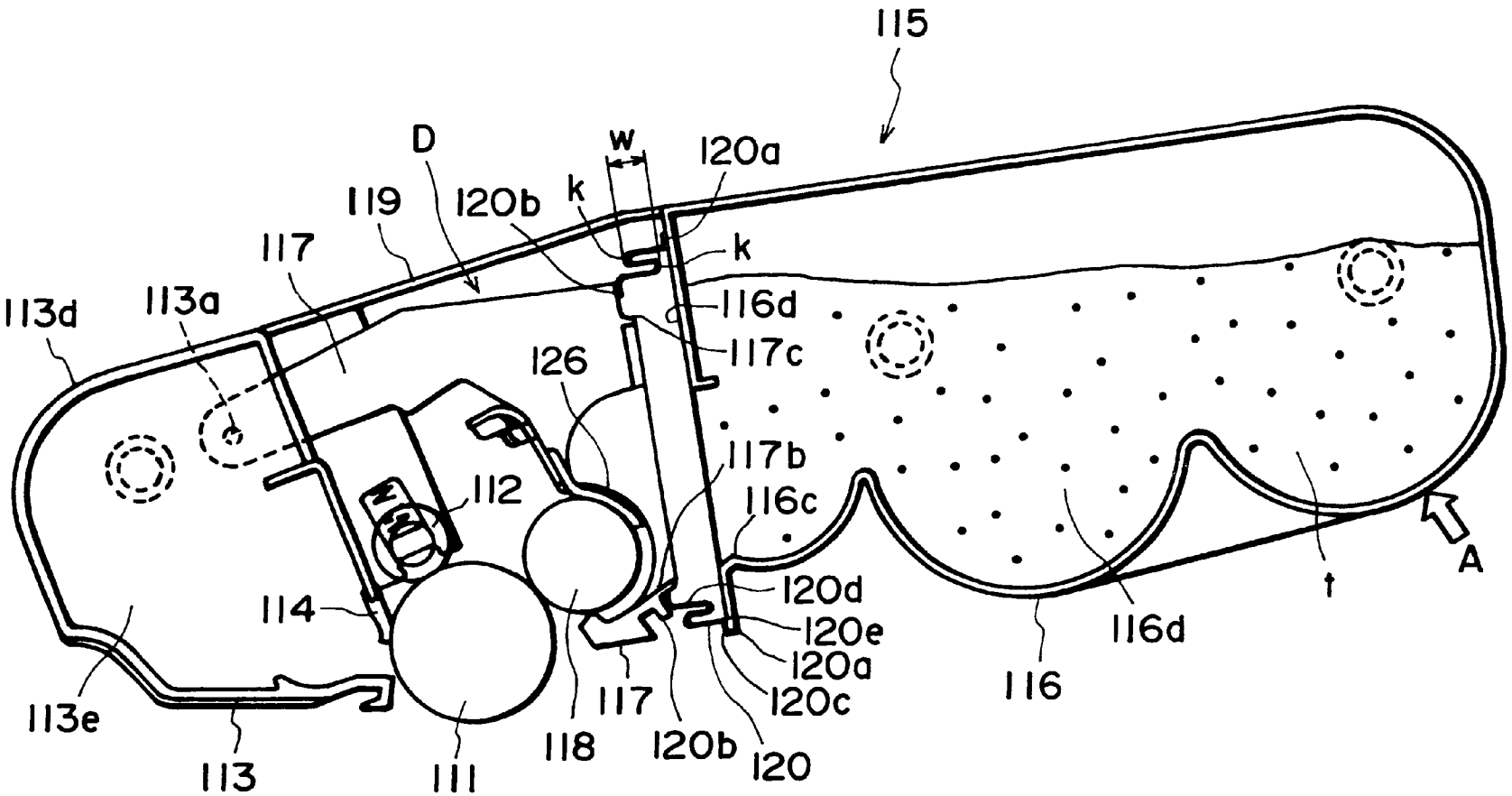
FIG. 10 is a vertical sectional view of the process cartridge in another embodiment of the present invention.
Figure 11:
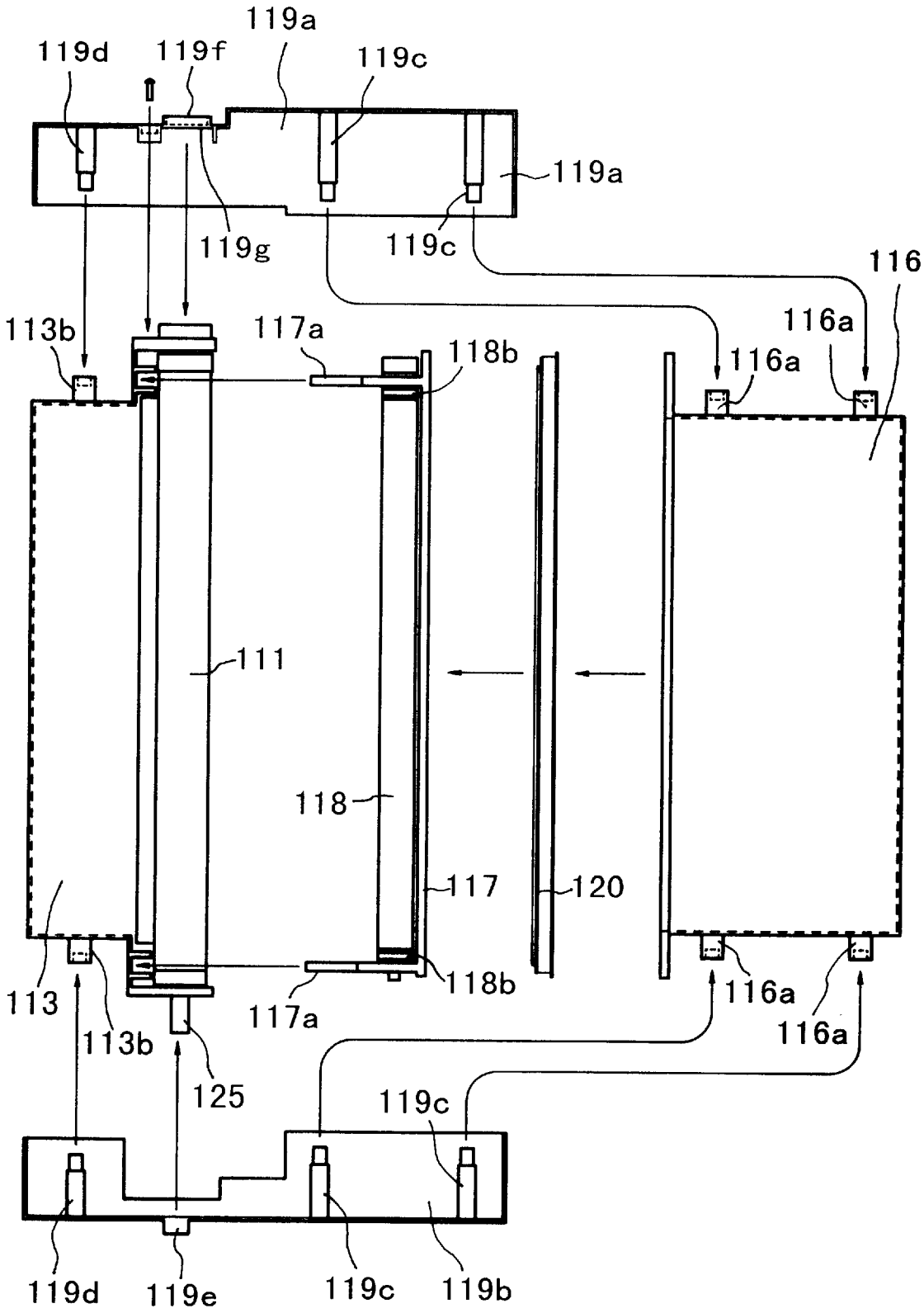
FIG. 11 is a plan view of the disassembled process cartridge in another embodiment of the present invention.

Referring to FIGS. 10, 11 and 21, the embodiments of the process cartridge in accordance with the present invention, different from the preceding embodiment, will be described.

Figure 12:
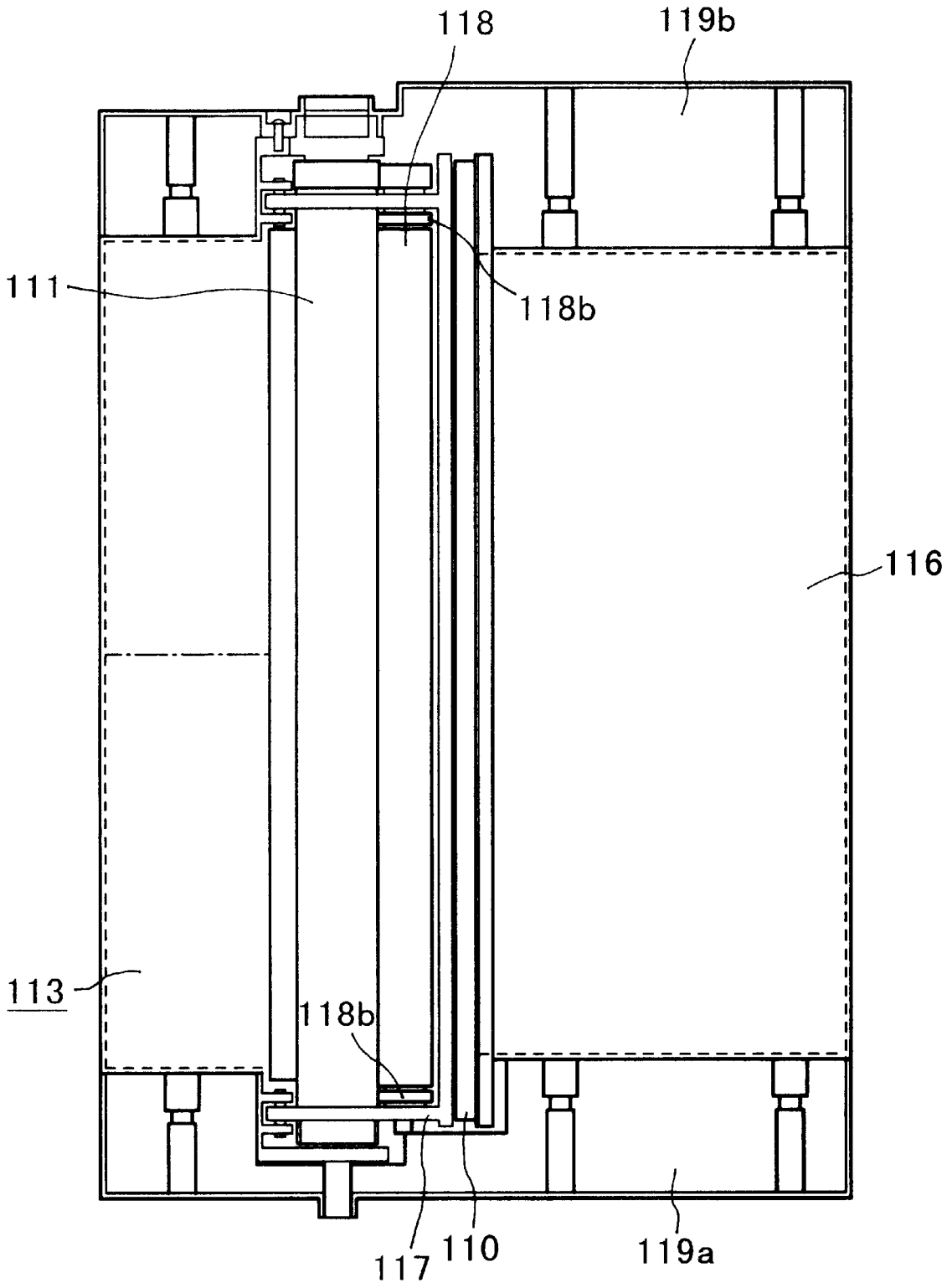
FIG. 12 is a horizontal sectional view of a portion of the process cartridge in another embodiment of the present invention.

FIGS. 11 and 12 are schematic drawings of one of the embodiments of a process cartridge in accordance with the present invention, and show the structure of the cartridge as seen from above.

Referring to FIG. 11, a toner storage frame 116 provided with a toner storage portion is accurately positioned relative to side covers 119*a* and 119*b*, and fixed thereto, by fitting the pins 119*c* of the side covers 119 (119*a* and 119*b*) into the holes or corresponding positioning bosses 116*a* of the toner-storage frame 116. The cleaning-means frame 113 is accurately positioned relative to the side covers 119*a* and 119*b*, and fixed thereto, by engaging the positioning bosses 113*b* with the positioning pins 119*d* of the side covers 119*a* and 119*b*. Consequently, the cleaning-means frame 113 and toner-storage frame 116 are integrally fixed to each other.

Figure 13:
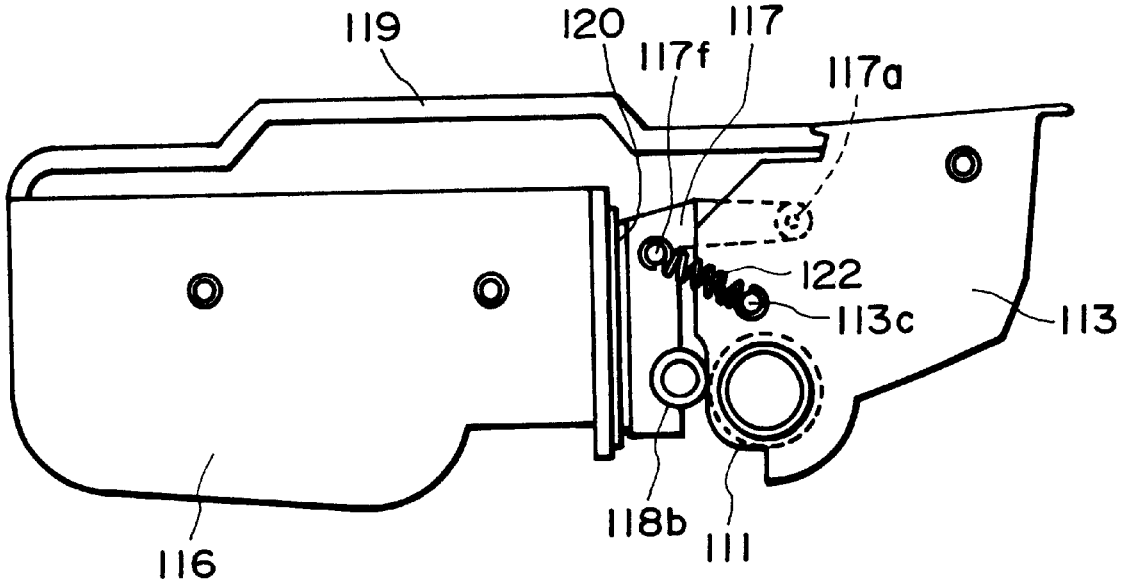
FIG. 13 is a side view of the process cartridge in another embodiment of the present invention.

Referring to FIG. 10, the developing-means frame 117 of a developing apparatus D is supported by the pins inserted in the holes 113*a* of the cleaning-means frame 113, being enabled to pivot about the center of the holes 113*a* while holding a development roller 118 and a development blade 112. Between the spring anchoring projection 113*c* of the cleaning-means frame 113, and the spring anchoring projection 117*f* of the developing-means frame 117, a tensional coil spring 112 is stretched as shown in FIG. 13. With the resiliency of the tensional coil spring 122, the spacer rings 118*b* are kept pressed upon the photosensitive drum 11, outside the image formation region. The spacer rings 18*b* are provided at the longitudinal ends of the development roller 118, one for one, and are greater in radius by a value equivalent to a development gap (approximately 300 $\mu$m) than the development roller 118.

With this arrangement, a gap is provided between the developing-means frame 117 and toner-storage frame 116. Further, the toner-storage frame 116 is structured so that its bottom well is approximately horizontal when the process cartridge is in the apparatus main assembly.

In this embodiment, the gap between the developing apparatus D and toner storage frame 116 is sealed. More specifically, the openings 117*b* and 116*c* of the developing apparatus D and frame 116, respectively, for allowing toner to pass, are connected by a flexible member 120, as a sealing member, shaped like a bellows. The flexible member 120 as a flexible seal is welded or glued to the frames 116 and 117, by the connective portions 120*a* and 120*b*, respectively.

The flexible member 120 has to be connected only to prevent toner from leaking while toner is passing between the openings 116*c* of the frame 116, and the opening 117*b* of the frame 117. Therefore, the frames 116 and 117 may be provided with a male and a female coupler, which surround the openings 116*c* and 117*b*, respectively, and the joint between them is sealed with a sealing member, provided that the couplers can absorb the displacement of the frames 116 and 117 relative to each other.

Figure 14:
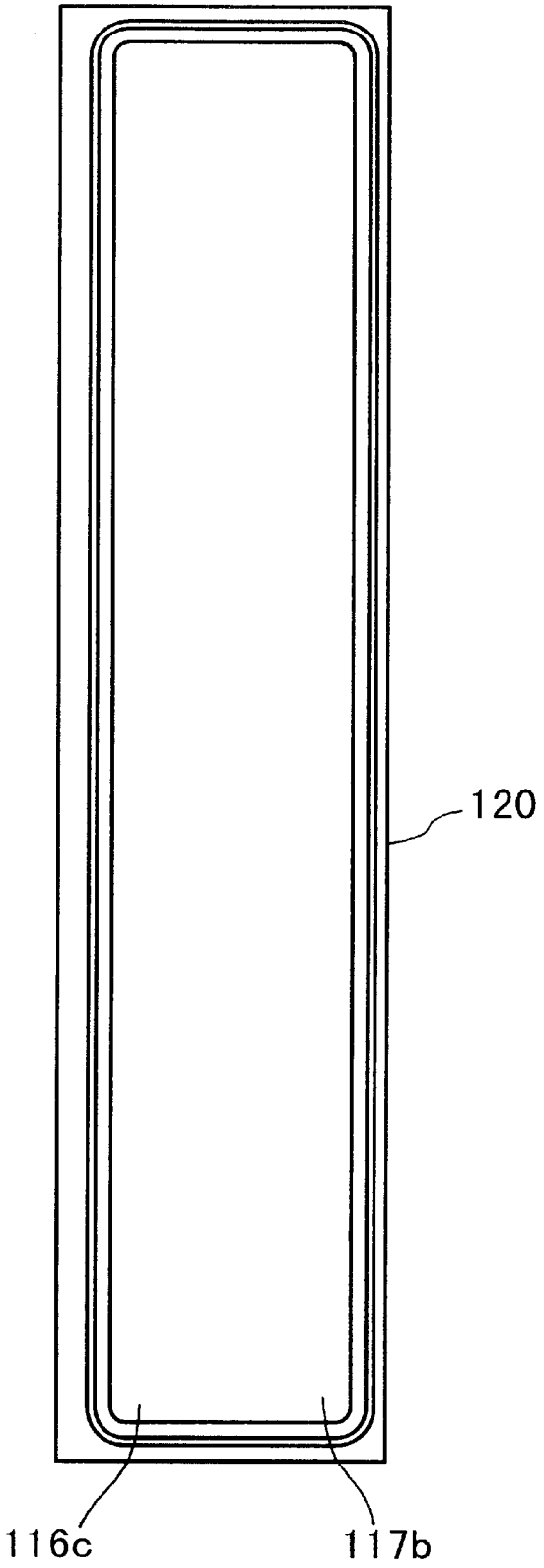
FIG. 14 is a front view of the sealing member in the preferred embodiment of the present invention.

Referring to FIG. 14, the flexible member 120 is shaped like a belt which surrounds the openings 117*b* and 116*c*.

The surfaces 116*d* and 117*c* of the frames 116 and 117, respectively, which face each other, are flat surfaces approximately parallel to each other. They surround the openings 116*c* and 117*b*, respectively. To the surface 116*d*, a connective portion 120*a* of the flexible member 120 is fixed, and to the surface 117*c*, the connective portion 120*b* of the flexible member 120 is fixed. The method used to fix these connective portions 120*a* and 120*b* to the surfaces 116*d* and 117*c* is thermal welding, or gluing. It is also possible to clasp the connective portions 120*a* and 120*b* with the use of clasping members (unillustrated), for example, a wear plate, and screw the clasping members to the surfaces 116*d* and 117*c*.

Figure 15:
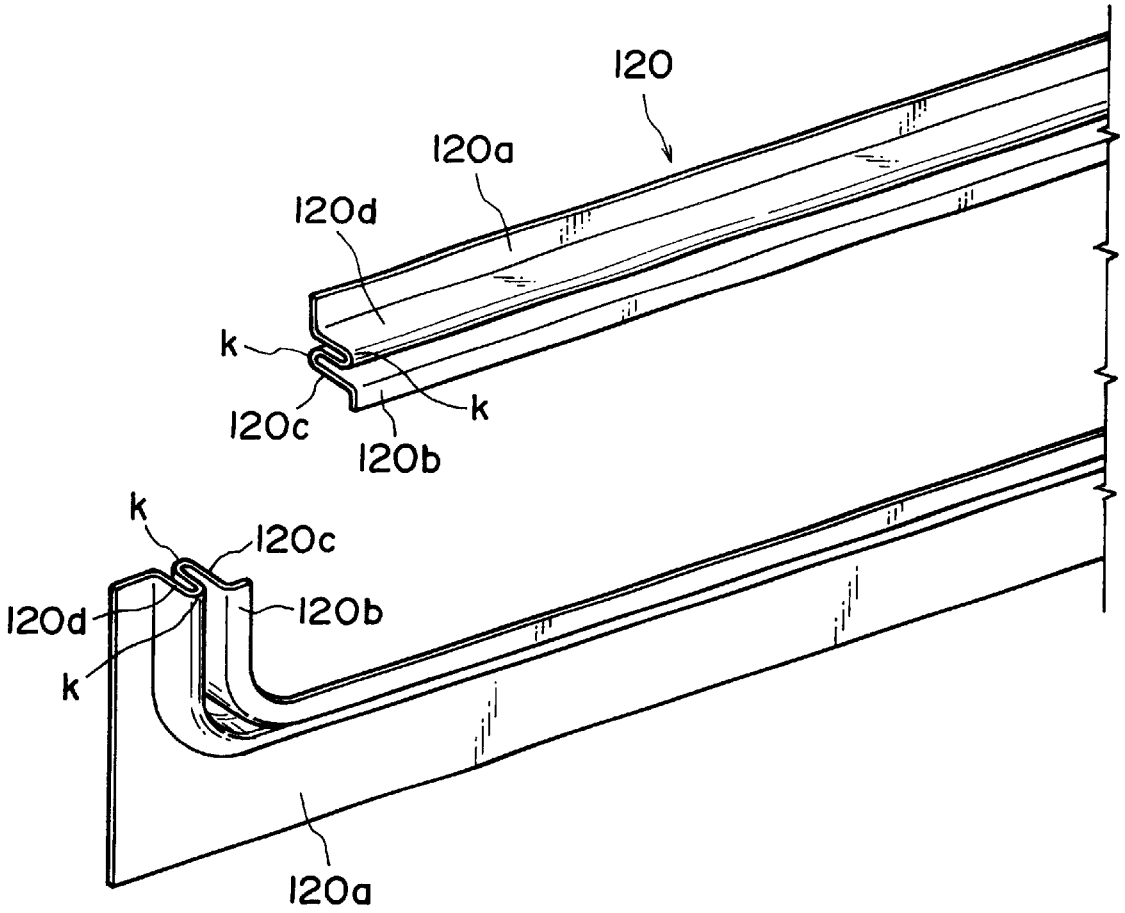
FIG. 15 is a perspective view of the sealing member in another embodiment of the present invention.

The flexible member 120 is uniform in terms of the shape of the cross section perpendicular to the surfaces 120*a* and 120*b*. More specifically, referring to FIGS. 10 and 15, in terms of cross section, the L-shaped outward sheath portion 120*c* and L-shaped inward sheath portion 120*d* of the flexible member 120 are connected by a zigzag portion. Further, the inward sheath portion 120*d* and outward sheath portion 120*c* overlap each other in terms of the direction parallel to the planes of the openings 116*d* and 117*c*. In other words, the flexible member 120 has two folds k. With the provision of this structural arrangement, even if the distance between the mutually facing surfaces 116*d* and 117*c* varies, or the surfaces 116*d* and 117*c* become displaced relative to each other in the direction parallel to their planes, or the surfaces 116*d* and 117*c* become nonparallel to each other, or the preceding displacements occur in combination, the flexible member 120 bends like a bellows, absorbing the displacements to keep sealed the passage between the openings 116*c* and 117*d*. Further, since the flexible member 120 is in the form of a bellows, it is very small in the resistance it generates as one or a plurality of the aforementioned displacements occur. Therefore, the flexible member 120 does not affect the contact pressure generated between the spacer rings 118*b* and photosensitive drum 111 by the tensional coil spring 122.

Further, when the frame 116 is full of toner, there is a possibility that the weight of the toner within the frame 116 will deform the side cover 119, and as a result, the mutually facing surfaces 116*d* and 117*c* will be displaced relative to each other. The flexible member 120 is capable of dealing with this type of situation. This type of deformation changes as the amount of the toner within the frame 116 is reduced. As a result, the positional relationship between the opposing surfaces 116*d* and 117*c* also changes. However, this displacement can also be dealt with by the flexible member 120.

The front and rear walls of the apparatus main assembly 27 are provided with a guide (unillustrated).

On the other hand, the process cartridge 115 is provided with a pair of shaft-like, cylindrical projections (unillustrated), which project outward from the cleaning-means frame 113 through the holes 119*e* and 119*f* of the side covers 119, one for one, and the axial lines of which are in alignment with the rotational axis of the photosensitive drum 111. When the process cartridge 115 is installed into the apparatus main assembly 27, the position of the process cartridge 15 relative to the apparatus main assembly 27 is fixed as these cylindrical projections engage with the positioning portions (unillustrated) of the apparatus main assembly 27. Since the frame 116 is relatively large, and the distance from the center of the photosensitive drum 111 to the center of gravity of the frame 116 is relatively large, a large amount of moment is generated in the direction to rotate the process cartridge 115 about the rotational axis of the photosensitive drum 111 in the clockwise direction. As a result, the point of the process cartridge 115, indicated by an arrow mark A in FIG. 10, comes into contact, and remains in contact, with the apparatus main assembly 27, fixing the maintaining the attitude of the process cartridge 115.

Regarding the preceding description, the material for the flexible member 120 is desired to be such elastomer that is similar in properties to the material used for the frames 113 and 116. In this embodiment, styrene resin was used as the frame material, and styrene elastomer was used as the material for the flexible member 120. This combination was excellent in terms of bonding. Other material such as rubber, urethane, silicon rubber, and the like may be also used as the material for the flexible member 120. As for the means for attaching the flexible member 120, adhesive or double-shaped adhesive tape may be used. Instead of these adhering means, a mechanically attaching means may be used. For example, the flexible member 120 may be clasped by a clasping member. Obviously, both connective means may be used in combination.

As for the molding method for the flexible member, injection molding or compression molding may be used. Further, material in the form of a sheet may be heat-pressed.

In order to minimize the reactive force of the flexible member 120, the direction of which is approximately parallel to the conveyance direction of the sheet S, the flexible member 120 is structured so that the portion between the folds k and k, the portion between the fold k and the connective portion 120*a*, and the portion between the fold k and the connective portion 120*b*, become parallel to the sheet conveyance direction, as shown in FIG. 10. However, the flexible member 120 may be folded so that the above described portions become perpendicular to the sheet conveyance direction.

Further, a fold width W, or the distance between the opposing two folds, of the flexible member 120 is determined so that the flexibility of the flexible member is not lost within a range in which the frames 117 and 116 are allowed to move relative to each other. The opening of the flexible member 120, which faces the opening 116*c*, is greater in both the horizontal and vertical directions than the opening 116*c*, and the opening of the flexible member 120, which faces the opening 117*b*, is smaller in both the horizontal and vertical direction than the opening 117*b*.

Figure 17:
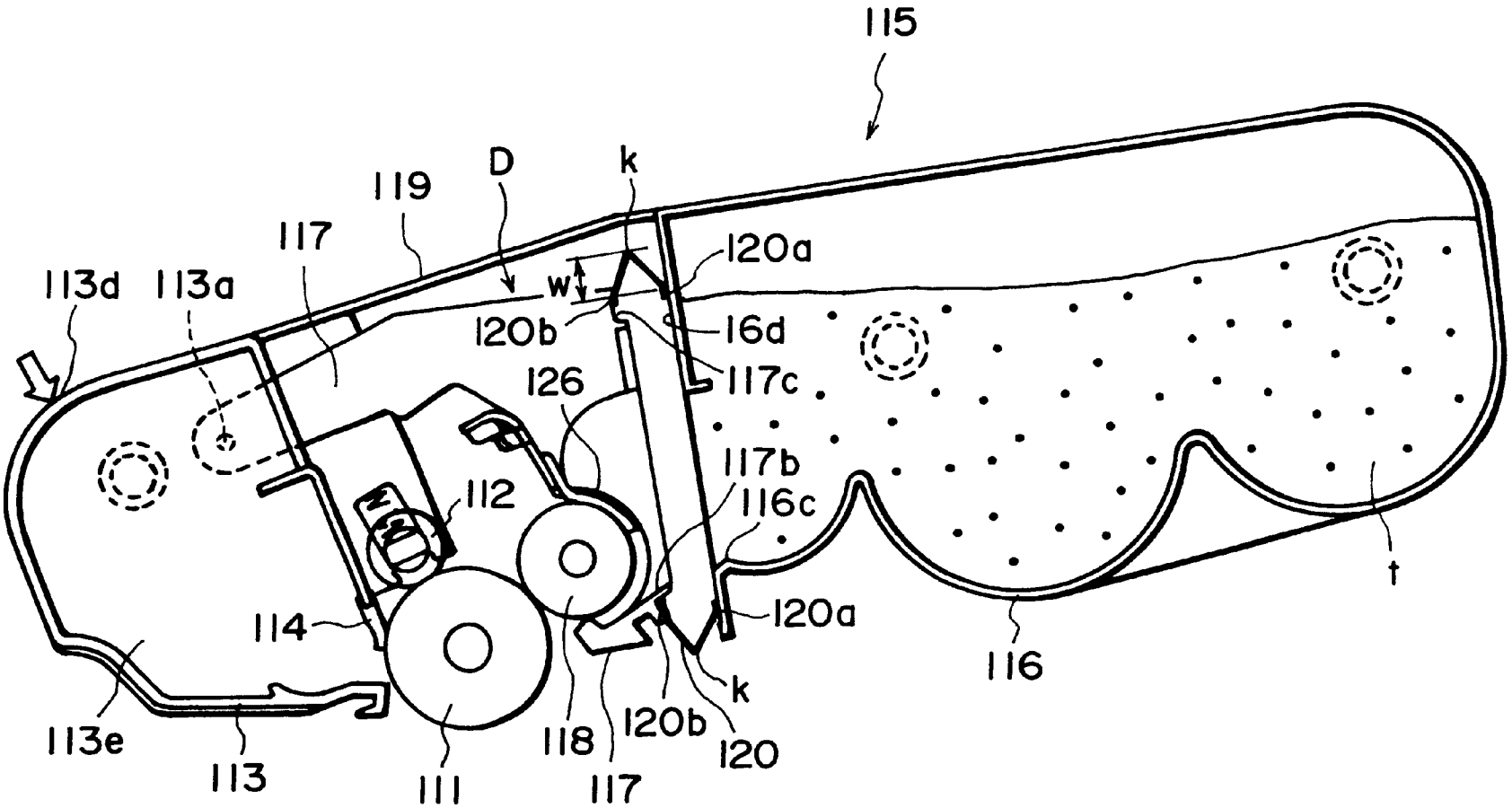
FIG. 17 is a vertical sectional view of the process cartridge in another embodiment of the present invention.

FIG. 17 shows an example of the flexible member 120, which has only a single fold k. Even if the flexible member 120 is provided with only one fold k, it can deal with the displacement of the frames 116 and 117 relative to each other, as long as the width W from the connective portion 120*b* to the fold k is rendered generous.

In the preceding description of the embodiments of the present invention, the bellows portion of the flexible member 120 was described with reference to its vertical sectional view. However, when shown in a horizontal sectional view, the direction in which the fold k projects is opposite to the direction in which it projects in the vetical sectional view. For example, the fold projecting inward in FIG. 16 projects ouward when seen in the horizontal sectional view.

The above described embodiments of the present invention may be summarized as follows.

The process cartridge 15 (115) removably installable in the main assembly 27 of an electrophotographic image forming apparatus, comprises:

the electrophotographic photosensitive drum 11 (111);

the development roller 18 (118) as a developing member for developing an electrostatic latent image formed on the electrophotographic photosensitive member 11 (111);

the toner storage frame 16 (116) provided with the toner storage portion 16*a* (116*a*) as a developer storing portion for storing the developer used for developing the electrostatic latent image with the use of the development roller 18 (118);

the cleaning means frame 13 (113) as a drum frame for supporting the electrophotographic photosensitive drum 11 (111);

the developing means frame 17 (117) which supports the development roller 18 (118) and is pivotally attached to the toner storage frame 16 (116);

the side covers 19 (119*a*) as the first end cover for holding together the cleaning means frame 13 (113) and developing means frame 17 (117), at each of the longitudinal ends of the cleaning means frame 13 (113) and developing means frame 17 (117); and the side cover 20 (119*b*) as the second end cover for holding together the cleaning means frame 13 (113) and developing means frame 17 (117), at each of the other longitudinal ends of the cleaning means frame 13 (113) and developing means frame 17 (117).

The developing-means frame 17 (117) and toner-storage frame 16 (116) are connected to each other, with the interposition of the sealing member 21 to 60, or the flexible member 120, and the flexible sealing member is pasted to the developing-means frame 17 (117) and toner-storage frame 16 (116).

The sealing member 60 is a hollow member and has a through hole 60*a*. One end of the through hole 60*a* faces the opening 16*c*, as a supply outlet, with which the toner-storage frame 16 is provided, and the other end of the through hole 60*a* faces the opening 17*a*, as a supply inlet, with which the developing-means frame 17 is provided. The opening 16*c* is an opening through which the developer t stored in the toner storage portion 16*a* is conveyed toward the development roller 18. The opening 17*a* is an opening through which the developer t is received into the developing means frame 17 after passing through the opening 16*c*. As for the sealing member 60, one end of its through hole 60*a* is pasted to the toner-storage frame 16, by the surface that surrounds the opening of the hole 60*a*, and the other end of the through hole 60*a* is pasted to the developing-means frame 17 by the surface that surrounds the opening of the hole 60*a*.

The sealing member 21 and flexible member 120 have at least one fold k between the surface b which they are pasted to the developing-means frames 17 and 117, respectively, and the surface by which they are pasted to the toner-storage frame 16 and 116, respectively. The sealing member 21 and flexible member 120 are in the form of a bellows, one end of which is pasted to the toner-storage frame 16 and 116, respectively, and the other end of which is pasted to the developing-means frame 17 and 117, respectively.

The flexible sealing members 21 and 60 are formed of elastic material, sheet, or film.

The material for the sealing members 21 and 60, and the material for the flexible member 120, are foamed urethane, ester resin, or polyurethane resin.

The side cover 19 is provided with a handle 29, which is grasped by an operator when the process cartridge 15 (115) is installed into, or removed from, the apparatus main assembly. The process cartridge 15 (115) is installed into, or removed from, the apparatus main assembly 27 in a direction parallel to the longitudinal direction of the electrophotographic photosensitive drum 11 (111).

The side cover 19 (119) is provided with the hole 19*a* (119*f*), through which the shaft 25 (125) of the electrophotographic photosensitive member 11 (111) projects. One of the longitudinal ends of the electrophotographic photosensitive member 11 (111) is supported by the cleaning-means frame 13 (113), by the shaft 25 (125). The position of the process cartridge 15 (115) relative to the apparatus main assembly 27 is fixed as the process cartridge 15 (115) is installed into the apparatus main assembly 27.

The top surface of the toner-storage frame 16 (116) is provided with a handle 30. The top surface refers to the surface that faces upward when the process cartridge 15 (115) is in the apparatus main assembly 27. The handle 30 is a portion that is grasped by an operator when the process cartridge 15 (115) is moved.

The side covers 19 and 20 (119*a* and 119*b*) are fixed to the cleaning-means frame 13 (113) and toner-storage frame 16 (116) with the use of screws 100.

The cleaning means frame 13 (113) has an exposure opening 131 (1131), which is an opening through which a beam of light modulated with image formation data is projected onto the electro-photographic photosensitive drum 11 (111) from the apparatus main assembly 27 after the installation of the process cartridge 15 (115) into the apparatus main assembly 27.

In the cleaning means frame 13 (113), the charge roller 12 (112), as a charging member for charging the electrophotographic photosensitive drum 11 (111), and the cleaning blade 14 (114) as a cleaning member for removing the developer remaining on the electrophotographic photosensitive drum 11 (111), are disposed.

The side covers 19 and 20 (119*a* and 119*b*) are fixed to the cleaning-means frame 13 (113) and toner-storage frame 16 (116) with the use of resin.

The side cover 19 is provided with the groove 19*e* in which the projecting member 17*e*, provided at one of the longitudinal ends of the developing means frame 17, is movably supported. The projecting member 17*e* formed of resinous material is an integral portion of the developing-means frame 17. The toner storage portion 16 (116) contains the developer t.

The assembly method for the process cartridge 15 (115) is as follows.

The assembly method for the process cartridge 15 (115) removably installable in the main assembly 27 of an electrophotographic image forming apparatus comprises:

(a) a drum attachment step for attaching the electrophotographic photosensitive drum 11 (111) to the cleaning-means frame 13 (113) as a drum frame;

(b) a frame joining step for joining the developing-means frame 17 (117) and toner storage frame 16 (116) in a manner to allow them to pivot relative to each other;

(c) a developing member attachment step for attaching the development roller 18 (118) as a developing means to the development means frame 17 (117), the development roller 18 (118) being a means for developing an electrostatic latent image formed on the electrophotographic photosensitive drum 11 (111);

(d) a developer filling step for filling the toner-storage frame 16 (116) with the developer t;

(e) a first end cover joining step for attaching the side cover 19 (119*e*) as the first end cover to the cleaning-means frame 13 (113) and the development-means frame 17 (117), at each of the longitudinal ends of the frames 13 (113) and 17 (117);

(f) a second end cover joining step for attaching the side cover 20 (119*b*) as the second end cover to the cleaning-means frame 13 (113) and the development-means frame 17 (117), at each of the other longitudinal ends of the frame 13 (113) and 17 (117).

In the frame joining step, the development-means frame 17 (117) and toner-storage frame 16 (116) are joined with each other in a manner to allow them to pivot relative to each other, with the interposition of the sealing member 21 (60) or the flexible sealing member 120, as a flexible member, between the two frames, so that one end of the flexible member is attached to the development-means frame 17 (117) and the other end of the flexible member is attached to the toner-storage frame 16 (116).

In the first end cover joining process and second end cover joining step, the side covers 19 (119*a*) and side cover 20 (119*b*) are attached to the cleaning-means frame 13 (113) and development-means frame 17 (117) with the use of screws.

In the first end cover joining step and second end cover joining step, the side covers 19 (119*a*) and side cover 20 (119*b*) are attached to the cleaning-means frame 13 (113) and development-means frame 17 (117) with the use of resin.

In the developer filling step, the developer t is filled into the developer storage portion of the toner-storage frame 16 (116) through the developer filling opening (unillustrated) provided at one of the longitudinal ends of the toner storage frame 16 (116).

Cartridge Installing Space in Main Assembly

Figure 19:
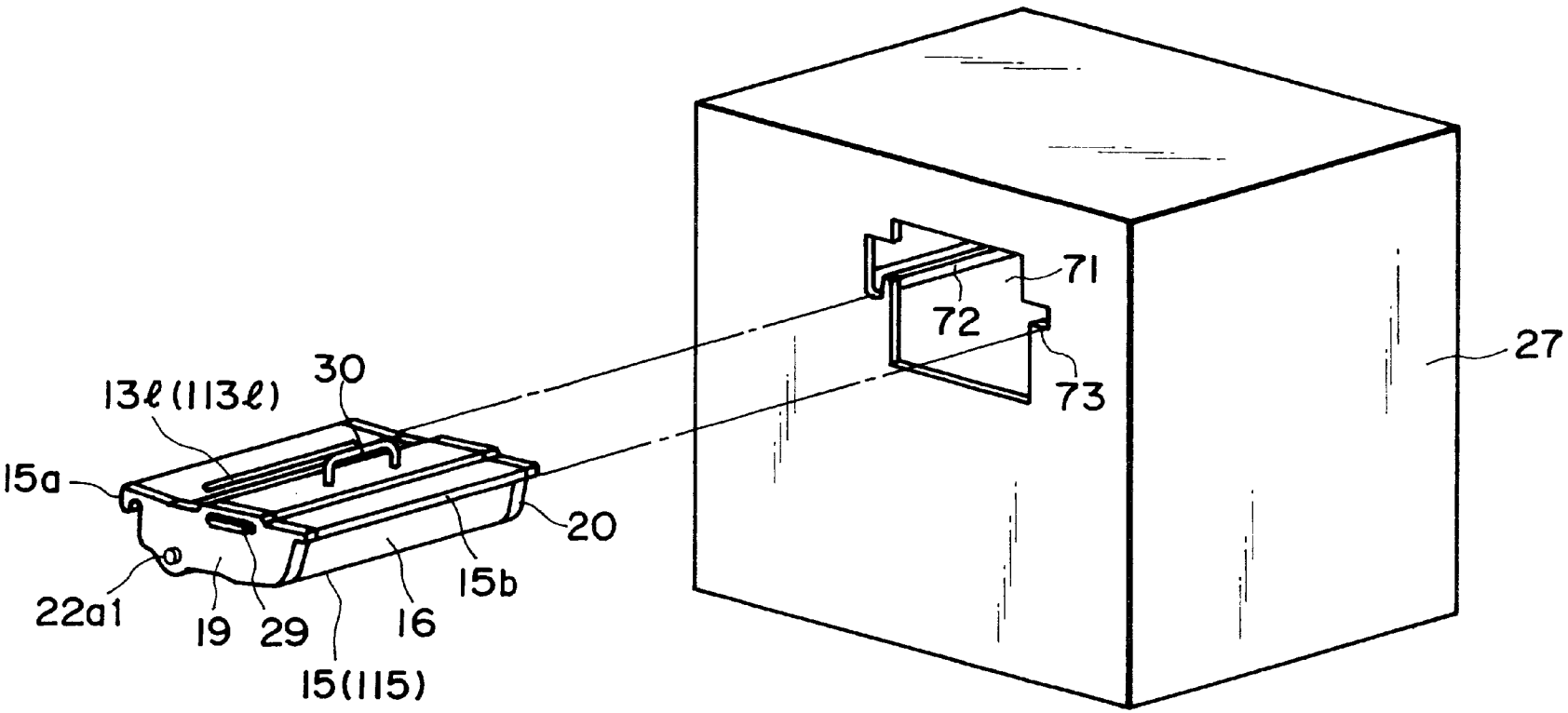
FIG. 19 is a perspective drawing which shows the installation and removal of the process cartridge into and from the main assembly of an image forming apparatus.

FIG. 19 is a perspective view of the cartridge installing space provided in the apparatus main assembly 17. As the front door (unillustrated) of the apparatus main assembly 17 is opened, the entrance to the cartridge installing space 71 becomes visible.

In the opposing sidewalls of this cartridge installing space 71, a pair of guide rails 72 and 73 are provided one for one, which extend in a direction perpendicular to the direction in which the sheet S is conveyed, and parallel to the surface of the sheet S. The guide rails 72 and 73 are disposed virtually parallel to each other, and also at virtually the same levels, that is, in a virtually horizontal plane.

The process cartridge 15 (115) is advanced into, or retracted out of, the above described cartridge installing space 71, in the longitudinal direction of the process cartridge 15 (115); the process cartridge 15 (115) is removably installed into the apparatus main assembly 17, with the guide portions 15*a* (115*a*) and 15*b* (115*b*) engaged in the corresponding guide rails 72 and 73 of the cartridge installing space 71.

As described in the foregoing, according to the present invention, the image quality is stabilized.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, comprising:

an electrophotographic photosensitive drum;

a developing member for developing an electrostatic latent image formed on said electrophotographic photosensitive drum;

a toner accommodation frame having a developer accommodating portion for accommodating a developer to be used by said developing member to develop the electrostatic latent image;

a drum frame for supporting the electrophotographic photosensitive drum;

a developing frame for supporting said developing member, said developing frame being swingably coupled with the toner accommodation frame;

a first end cover connected with said drum frame and said developing frame at one longitudinal end of each of said drum frame and said developing frame; and a second end cover connected with said drum frame and said developing frame at the other longitudinal end of said drum frame and said developing frame.

2. An apparatus according to claim 1, wherein said developing frame and said toner accommodation frame are connected by a flexible seal with each other, and said flexible seal is bonded to said developing frame and said toner accommodation frame.

3. A process cartridge according to claim 2, wherein said flexible seal is provided with a through-hole having an end facing a supply opening provided in said toner accommodation frame and having the other end facing a receiving opening provided in said developing frame, wherein said supply opening permits a developer accommodated in said developer accommodating portion to move toward said developing member, and said receiving opening receives the developer having passed through said supply opening, and wherein said flexible seal is bonded to said toner accommodation frame around an end of said through-hole, and is bonded to said developing frame around the other end of said through-hole.

4. A process cartridge according to claim 2, wherein said flexible seal has at least one fold between a portion bonded to said developing frame and a portion bonded to said toner accommodation frame, wherein said flexible seal is bellow-like having an end bonded to said toner accommodation frame and the other end bonded to said developing frame.

5. A process cartridge according to claim 2, wherein said flexible seal is made of an elastic member, a sheet member, or a film member.

6. A process cartridge according to claim 5, wherein said flexible seal is made of urethane foam, ester resin material or polyurethane resin material.

7. A process cartridge according to claim 1, wherein said first end cover is provided with a grip that facilitates handing of said process cartridge by an operator, wherein said process cartridge is mounted to and demounted from the main assembly of the apparatus in a longitudinal direction of said electrophotographic photosensitive drum.

8. A process cartridge according to claim 1 or 7, wherein said first end cover is provided with a hole through which a shaft of said electrophotographic photosensitive drum extends out, said shaft supporting an end of said electrophotographic photosensitive drum on said drum frame, and said shaft is positioned to the main assembly of the apparatus when said process cartridge is mounted to the main assembly of said apparatus.

9. A process cartridge according to claim 1, wherein said toner accommodation frame is provided on its top surface, when said process cartridge is mounted to the main assembly of said apparatus, with a grip for facilitating handling of said process cartridge by an operator.

10. A process cartridge according to claim 1, wherein said drum frame is provided with an exposure opening which permits information light from the main assembly of the apparatus to be projected on said electrophotographic photosensitive drum to pass, when said process cartridge is mounted to the main assembly of the apparatus.

11. A process cartridge according to claim 1 or 10, wherein said drum frame further supports a charge member for charging said electrophotographic photosensitive drum and a cleaning member for removing a residual developer from said electrophotographic photosensitive drum.

12. A process cartridge according to claim 2, 3, 4, 7, 9, or 10, wherein said first end cover and said second end cover are fastened to said drum frame and said toner accommodation frame by screws.

13. A process cartridge according to claim 2, 3, 4, 7, 9, or 10, wherein said first end cover and said second end cover are bonded with said drum frame and said toner accommodation frame by resin material.

14. A process cartridge according to claim 1 or 7, wherein said first end cover is provided with a groove for movably supporting a projection provided at one longitudinal end of said developing frame, and wherein said projection and said developing frame are of integrally molded resin material.

15. A process cartridge according to claim 1, wherein said developer accommodating portion contains a developer.

16. An assembling method for a process cartridge which is detachably mountable to a main assembly of an electrophotographic image forming apparatus, said method comprising:

(a) a drum mounting step of mounting an electrophotographic photosensitive drum to a drum frame;

(b) a frame coupling step of swingably coupling a developing frame and a toner accommodation frame with each other;

(c) a developing member mounting step of mounting a developing member to the developing frame, wherein said developing member is effective to develop an electrostatic latent image formed on the electrophotographic photosensitive drum;

(d) a developer filling step of filling the developer into the toner accommodation frame;

(e) a first end cover coupling step of coupling a first end cover to said drum frame and said developing frame at one longitudinal end of each of said drum frame and said developing frame; and (f) a second end cover coupling step of coupling a second end cover to said drum frame and said developing frame at the other longitudinal end of each of said drum frame and said developing frame.

17. A method according to claim 16, wherein in said frame coupling step, said developing frame and said toner accommodation frame are swingably coupled by mounting a flexible member between said developing frame and said toner accommodation frame.

18. A method according to claim 16 or 17, wherein in said first end cover coupling step and said second end cover coupling step, the first end cover and the second end cover are fastened to said drum frame and said developing frame by screws.

19. A method according to claim 16 or 17, wherein in said first end cover coupling step and said second end cover coupling step, the first end cover and the second end cover are bonded by resin material to the drum frame and the developing frame.

20. A method according to claim 16 or 17, wherein the toner accommodation frame has a developer accommodating portion, wherein in said developer filling step, the developer is supplied into said developer accommodating portion through a developer filling opening provided at one longitudinal end of said toner accommodation frame.

21. An electrophotographic image forming apparatus for forming an image on a recording material, to which a process cartridge is detachably mountable, said apparatus comprising:

(a) a mounting portion for detachably mounting the process cartridge, which includes:

an electrophotographic photosensitive drum;

a developing member for developing an electrostatic latent image formed on said electrophotographic photosensitive drum;

a toner accommodation frame having a developer accommodating portion for accommodating a developer to be used by said developing member to develop the electrostatic latent image;

a drum frame for supporting said electrophotographic photosensitive drum;

a developing frame for supporting said developing member, said developing frame being swingably coupled with said toner accommodation frame;

a first end cover connected with said drum frame and said developing frame at one longitudinal end of each of said drum frame and said developing frame; and a second end cover connected with said drum frame and said developing frame at the other longitudinal end of said drum frame and said developing frame;

(b) a main assembly side driving force transmitting member for transmitting a driving force to the electrophotographic photosensitive drum provided in the process cartridge mounted to said mounting portion; and (c) feeding means for feeding the recording material.

22. A process cartridge detachably mountable to a main assembly of an electrophotographic image forming apparatus, comprising:

an electrophotographic photosensitive drum;

a developing member for developing an electrostatic latent image formed on said electrophotographic photosensitive drum;

a toner accommodation frame having a developer accommodating portion for accommodating a developer to be used by said developing member to develop the electrostatic latent image;

a drum frame for supporting said electrophotographic photosensitive drum;

a drum shaft supporting said electrophotographic photosensitive drum on said drum frame, wherein said drum shaft is positioned relative to the main assembly of the electrophotographic image forming apparatus adjacent one longitudinal end of the electrophotographic photosensitive drum when said process cartridge is mounted to the main assembly of the electrophotographic image forming apparatus;

a developing frame for supporting said developing member, said developing frame being swingably coupled with said toner accommodation frame;

a first end cover connected with said drum frame and said toner accommodation frame at one longitudinal end of each of said drum frame and toner accommodation frame, wherein a portion of said drum shaft adjacent said one longitudinal end extends outwardly through a hole formed in said first end cover; and a second end cover connected with said drum frame and said toner accommodation frame at the other longitudinal end of said drum frame and said toner accommodation frame.

23. An apparatus according to claim 22, wherein said developing frame and said toner accommodation frame are connected by a flexible seal with each other, and said flexible seal is bonded to said developing frame and said toner accommodation frame.

24. A process cartridge according to claim 23, wherein said flexible seal is provided with a through-hole having an end facing a supply opening provided in said toner accommodation frame and having the other end facing a receiving opening provided in said developing frame, wherein said supply opening permits a developer accommodated in said developer accommodating portion to move toward said developing member, and said receiving opening receives the developer having passed trough said supply opening, and wherein said flexible seal is bonded to said toner accommodation frame around an end of said through-hole, and is bonded to said developing frame around the other end of said through-hole.

25. A process cartridge according to claim 23 or 24, wherein said flexible seal has at least one fold between a portion bonded to said developing frame and a portion bonded to said toner accommodation frame, and said flexible seal is bellow-like having an end bonded to said toner accommodation frame and the other end bonded to said developing frame.

26. A process cartridge according to claim 25, wherein said flexible seal is made of an elastic member, a sheet member or a film member.

27. A process cartridge according to claim 22, wherein said first end cover is provided with a grip which facilitates handling of said process cartridge by an operator, wherein said process cartridge is mounted to and demounted from the main assembly of the electrophotographic image forming apparatus in a longitudinal direction of said electrophotographic photosensitive drum.

28. A process cartridge according to claim 22, 24, or 27, wherein said toner accommodation frame is provided on its top with a surface with a grip for facilitating handling of said process cartridge by an operator when said process cartridge is mounted to the main assembly of said apparatus.

29. A process cartridge according to claim 22, wherein said first end cover and said second end cover are fastened to said drum frame and said toner accommodation frame by screws.

30. A process cartridge according to claim 22, wherein sad first end cover and said second end cover are bonded with said drum frame and said end by resin material.

31. A process cartridge according to claim 25, wherein said first end cover is provided with a groove for movably supporting a projection provided at one longitudinal end of said developing frame, and wherein said projection and said developing frame are made of integrally molded resin material.

32. A process cartridge according to claim 22, wherein said developer accommodating portion contains a developer.

33. An assembling method for a process cartridge which is detachably mountable to a main assembly of an electrophotographic image forming apparatus, said method comprising:

(a) a drum mounting step of mounting an electrophotographic photosensitive drum to a drum frame;

(b) a frame coupling step of swingably coupling a developing frame and a toner accommodation frame with each other;

(c) a developing member mounting step of mounting a developing member to the developing frame, wherein said developing member is effective to develop an electrostatic latent image formed on the electrophotographic photosensitive drum;

(d) a developer filling step of filling the developer into the toner accommodation frame;

(e) a first end cover coupling step of coupling a first end cover to said drum frame and said toner accommodation frame at one longitudinal end of each of said drum frame and said toner accommodation frame; and (f) a second end cover coupling step of coupling a second end cover to said drum frame and said toner accommodation frame at the other longitudinal end of each of said drum frame and said toner accommodation frame.

34. A method according to claim 33, wherein in said frame coupling step, said developing frame and said toner accommodation frame are swingably coupled by mounting a flexible member extending between said developing frame and said toner accommodation frame.

35. A method according to claim 33 or 34, wherein in said first end cover coupling step and said second end cover coupling step, the first end cover and the second end cover are fastened to said drum frame and said toner accommodation frame by screws.

36. A method to claim 33 or 34, wherein in said first end cover coupling step and said second end cover coupling step, the first end cover and the second end cover are bonded by resin material to the drum frame and said toner accommodation frame.

37. A method coupling to claim 33, wherein in said developer filling step, the developer is supplied into a developer accommodating portion through a developer filling opening provided at one longitudinal end of said toner accommodation frame.

38. An electrophotographic image forming apparatus for forming an image on a recording material, to which a process cartridge is detachably mountable, said apparatus comprising:

(a) a mounting portion for mounting the process cartridge, which includes:

an electrophotographic photosensitive drum;

a developing member for developing an electrostatic latent image formed on said electrophotographic photosensitive drum;

a toner accommodation frame having a developer accommodating portion for accommodating a developer to be used by said developing member to develop the electrostatic latent image;

a drum frame for supporting said electrophotographic photosensitive drum;

a drum shaft supporting said electrophotographic photosensitive drum on said drum frame, wherein said drum shaft is positioned relative to a main assembly of the electrophotographic image forming apparatus adjacent one longitudinal end of the electrophotographic photosensitive drum when said process cartridge is mounted to the main assembly of the electrophotographic image forming apparatus;

a developing frame for supporting said developing member, aid developing frame being swingably coupled with said toner accommodation frame;

a first end cover connected with said drum frame and said toner accommodation frame at one longitudinal end of each of said drum frame and toner accommodation frame, wherein a portion of said drum shaft adjacent said one longitudinal end extends outwardly through a hole formed in said first end cover; and a second end cover connected with said drum frame and said toner accommodation frame at the other longitudinal end of said drum frame and said toner accommodation frame;

(b) a main assembly side driving force transmitting member for transmitting a driving force to the electrophotographic photosensitive drum provided in the process cartridge mounted to said mounting portion; and (c) feeding means for feeding the recording material.

* * * * *

UNITED STATES PATENT AND TRADEMARK OFFICE

CERTIFICATE OF CORRECTION

PATENT NO. : 6,519,431 B1
DATED : February 11, 2003
INVENTOR(S) : Shinjiro Toba et al.

It is certified that error appears in the above-identified patent and that said Letters Patent is hereby corrected as shown below:

Column 1,
Lines 25 and 29, “mountably” should read -- mountable --.
Line 48, “is” (second occurrence) should be deleted.

Column 4,
Line 5, “electrophoto-graphic” should read -- electrophotographic --.

Column 5,
Line 43, “encls” should read -- ends --.

Column 8,
Line 66, “Forming” should read -- forming --.

Column 10,
Line 14, “development means” should read -- development-means --.
Line 20, “development-frames” should read -- development-means --.
Line 30, “at” should read -- as --.
Line 62, “are” should read -- and --.

Column 12,
Line 53, “electro-photographic” should read -- electrophotographic --.

Column 18,
Line 15, “fixing the” should read -- fixing and --.
Line 24, “be also” should read -- also be --.

Column 19,
Line 3, “ouward” should read -- outward --.
Lines 18 and 26, “cleaning means” should read -- cleaning-means --.
Lines 21 and 32, “developing means” should read -- developing-means --.
Line 27, “oping means” should read -- oping-means --.
Lines 28, 31 and 33 “cleaning means” should read -- cleaning-means --.
Lines 34 and 50, “developing means” should read -- developing-means --.

Column 20,
Lines 24-26, should be deleted.
Line 30, “electro-photographic” should read -- electrophotographic --.
Line 39, “disposed.” should read -- disposed. ¶ The side covers 19 and 20 (119*a* and 119*b*) are fixed to the cleaning-means frame 13 (113) and toner-storage frame 16 (116) with the use of screws 100. --

UNITED STATES PATENT AND TRADEMARK OFFICE

CERTIFICATE OF CORRECTION

PATENT NO. : 6,519,431 B1
DATED : February 11, 2003
INVENTOR(S) : Shinjiro Toba et al.

It is certified that error appears in the above-identified patent and that said Letters Patent is hereby corrected as shown below:

Column 20 cont'd,
Line 60, "toner storage" should read -- toner-storage --.
Line 64, "development means" should read -- developing-means --.

Column 21,
Line 7, "17 (117);" should read -- 17 (117); and --.

Column 22,
Line 23, "An apparatus" should read -- A process cartridge --.
Line 55, "handing" should read -- handling --.

Column 25,
Line 8, "An apparatus" should read -- A process cartridge --.
Line 22, "trough" should read -- through --.

Column 26,
Line 36, "method" should read -- method according --.
Line 41, "coupling" should read -- according --.

Column 27,
Line 5, "aid" should read -- said --.

Signed and Sealed this

Thirteenth Day of January, 2004

JON W. DUDAS
*Acting Director of the United States Patent and Trademark Office*